US005489962A

United States Patent [19]

Miyazawa et al.

[11] Patent Number: 5,489,962

[45] Date of Patent: Feb. 6, 1996

[54] PHOTOSENSITIVE MATERIAL PROCESSING APPARATUS

[75] Inventors: Yorikatsu Miyazawa; Hideo Ishii; Yoshifumi Tsubaki; Toshiyuki Ikariya; Hideo Kobayashi; Yasuhiro Oka, all of Hino, Japan

[73] Assignee: Konica Corporation, Tokyo, Japan

[21] Appl. No.: 261,847

[22] Filed: Jun. 17, 1994

[30] Foreign Application Priority Data

| | | | |
|---|---|---|---|
| Jun. 23, 1993 | [JP] | Japan | 5-152127 |
| Oct. 26, 1993 | [JP] | Japan | 5-267512 |
| Dec. 28, 1993 | [JP] | Japan | 5-336742 |
| Dec. 28, 1993 | [JP] | Japan | 5-336743 |
| Dec. 28, 1993 | [JP] | Japan | 5-336744 |
| Mar. 4, 1994 | [JP] | Japan | 6-034822 |

[51] Int. Cl.[6] ..... G03D 3/02

[52] U.S. Cl. ..... 354/324

[58] Field of Search ..... 354/324; 430/450, 430/465, 458, 490; 134/268, 64 P, 64 R, 122 P, 122 R

[56] References Cited

U.S. PATENT DOCUMENTS

| | | | |
|---|---|---|---|
| 3,348,733 | 10/1967 | Johnson | 221/248 X |
| 3,680,736 | 8/1972 | Viessmann | 221/231 X |
| 4,306,649 | 12/1981 | Berge | 221/298 X |
| 4,377,368 | 3/1983 | Koch | 221/298 X |
| 4,405,059 | 9/1983 | Kull | 221/298 X |
| 4,949,123 | 8/1990 | Takashima | 355/260 |
| 5,240,822 | 8/1993 | Tanaka | 430/450 |
| 5,318,061 | 6/1994 | Saito | 354/324 X |
| 5,351,103 | 9/1994 | Komatsu et al. | 354/324 |
| 5,400,105 | 3/1995 | Koboshi et al. | 354/324 |

FOREIGN PATENT DOCUMENTS

| | | |
|---|---|---|
| 0537788A2 | 4/1993 | European Pat. Off. . |
| WO92/20013 | 11/1992 | WIPO . |

*Primary Examiner*—D. Rutledge

*Attorney, Agent, or Firm*—Frishauf, Holtz, Goodman, Langer & Chick

[57] ABSTRACT

An apparatus for processing a photosensitive material includes a device to replenish a tablet of a solid processing agent into a processing tank in which a cross-section of the tablet is shaped in a circle. A container in which plural tablets are accommodated is detachably mounted on the device. The plural tablets are accommodated in such a manner that an outer circumference of each tablet is contacted with that of the others.

20 Claims, 29 Drawing Sheets

INITIAL POSITION

J1A ENTER

J1B ENTER

J1A DROP

J1B DROP

STOP

J1A DROP

J1B DROP

STOP

PHOTOSENSITIVE MATERIAL PROCESSING APPARATUS

BACKGROUND OF THE INVENTION

The present invention relates to a photosensitive material processing apparatus, and more particularly relates to an automatic developing apparatus for developing silver halide photosensitive material. Specifically, the present invention relates to an improvement in a processing agent supply mechanism provided in an automatic developing apparatus. In other words, the present invention relates to a compact automatic developing apparatus in which dissolution work is avoided so that the workability can be greatly improved and further excellent photographic characteristics can be stably provided.

After silver halide material has been exposed to light, it is subjected to the processing of development, desilvering, washing and stabilization. Usually, this processing is conducted by an automatic developing apparatus. In this case, a replenishment type developing apparatus is generally adopted, in which a replenisher is fed into the automatic developing apparatus. Due to the foregoing replenishment type developing apparatus, the degree of activity of the processing agent in a processing tank can be controlled to be a predetermined level.

In the replenishment type developing apparatus, objects of the replenishment are to dilute substance that has dissolved out from photosensitive material, and to replenish components that have evaporated and consumed. As a result of replenishment, a large amount of solution overflows and is discharged out of the developing apparatus.

In order to process photosensitive materials on a commercial base, it is necessary to reduce the cost and labor. Also, it is necessary to prevent the public pollution. Further, in order to enhance the commodity value, it is necessary to use a processing solution, the amount of which is as small as possible, and it is also necessary that the processing performance is stable and excellent.

In order to meet the demand described above, a method is disclosed in the official gazette of W092/20013, by which almost all processing agent components are solidified and directly charged into a processing tank.

However, this method is disadvantageous in that a moisture proof measure can not be appropriately taken. Further, powder generated from the solidified processing agent is scattered and mixed in another processing tank, so that the photographic performance is deteriorated. Consequently, it is urgent to develop technology for solving the above problems.

In the processing of photosensitive material, the quality of processing agent must be very severely controlled. Processing is usually conducted around a temperature of 40° C. Therefore, the humidity is very high in the processing apparatus. Unless much consideration is given to the storage of solid processing agent, it absorbs moisture in the apparatus so that the quality of the processing agent is deteriorated before it is sapplied into the processing tank, and further it becomes impossible to stably supply the processing agent. For this reason, it is very important to take measures of moisture proof in the processing tank of photosensitive material.

SUMMARY OF THE INVENTION

The present invention has been achieved to overcome the disadvantages of the prior art described above. It is an object of the present invention to provide a compact photosensitive material processing apparatus having stable photographic performance and high workability, and in the photosensitive material processing apparatus, moisture proof measures to protect the solid processing agent can be taken and further powder of the solid processing agent is not scattered.

The above object can be accomplished by the present invention described as follows. The photosensitive material processing apparatus of the present invention comprises: a processing tank for accommodating a processing solution to process the photosensitive material that has already been exposed to light; and a solid processing agent replenishing device for replenishing a tablet type solid processing agent accommodated in an accommodating container into the processing tank by dropping the agent in the tank. In the above photosensitive material processing apparatus, the solid processing agent replenishing device includes: an accommodating container for accommodating a plurality of tablets of solid processing agent, the accommodating container having a discharge opening for discharging the solid processing agent; and an accommodating container charging means for holding the accommodating container in an inclined disposition so that the tablets of solid processing agent accommodated in the container can be moved to the discharge opening side.

The solid processing agent replenishing device used for the photosensitive material processing apparatus of the present invention comprises: an accommodating container for accommodating a plurality of tablets of solid processing agent, the section of which is circular, wherein the tablets are aligned in the container in such a manner that the circumference of each tablet is externally contacted with each other, the accommodating container having a discharge opening for discharging the tablets of solid processing agent, the discharge opening being provided with a slidable cover member by which the discharge opening can be opened and closed; an accommodating container charging means for detachably holding the accommodating container, the accommodating container charging means placing the discharge opening at a lower position so that the tablets of solid processing agent accommodated in the container can be slid to the discharge opening side; and a supplying means composed of a housing member and a processing agent receiving member, the housing member having an inlet for receiving the tablets of solid processing agent discharged from the discharge opening of the accommodating container and also having an outlet for discharging the tablets into the processing tank, the processing agent receiving member rotatably disposed in an inner circumference of the housing member and receiving a predetermined amount of tablets from the inlet and conveying them to the outlet.

The solid processing agent replenishing device used for the photosensitive material processing apparatus of the present invention comprises: an accommodating container including a container main body for accommodating a solid processing agent, and a sliding cover member for opening and closing a discharge opening of the container main body; and an accommodating container charging means for detachably holding the accommodating container, the accommodating container charging means placing the discharge opening at a lower position so that the tablets of solid processing agent accommodated in the container can be slid to the discharge opening side, the accommodating container charging means including a lock means for locking the accommodating container at a position where the tablets of solid processing agent accommodated in the container can be slid to the discharge opening side, the accommodating container charging means also including a release means for releasing the locked accommodating container in accordance with the rocking motion of a handle means.

The solid processing agent replenishing device used for the photosensitive material processing apparatus of the present invention comprises: a housing member having an inlet for receiving the tablets of solid processing agent discharged from the discharge opening of the accommodating container and also having an outlet for discharging the tablets into the processing tank; and a conveyance member rotatably disposed on an inner circumference of the housing member, the conveyance member receiving a predetermined amount of tablets of solid processing agent from the inlet and conveying them to the outlet. In this case, the housing member is composed of a fixed frame, and a cover member capable of being opened and closed with respect to the fixed frame, and when the cover member is opened, the processing agent receiving member can be exposed or taken out.

The solid processing agent replenishing device used for the photosensitive material processing apparatus of the present invention comprises: an accommodating container for accommodating a plurality of tablets of solid processing agent, the accommodating container being capable of discharging the tablets of solid processing agent, the accommodating container including a discriminating section for discriminating the type of solid processing agent; an accommodating container charging means for rotatably holding the accommodating container, the accommodating container charging means being capable of rotating the accommodating container from the first position before charging the accommodating container thereon to the second position at the time of replenishing the processing agent, the accommodating container charging means including a discrimination receiving section corresponding to the discriminating section of the accommodating container; and a lock means for locking the accommodating container charging means at the first position so as to prevent the occurrence of a malfunction and for releasing the accommodating container from the locking when the discriminating section coincides with the discrimination receiving section so that the accommodating container can be rotated to the second position.

The solid processing agent replenishing device used for the photosensitive material processing apparatus of the present invention comprises: an accommodating container including a discharge opening section capable of discharging the tablets of solid processing agent, and a cover member capable of opening and closing the discharge opening section, wherein the accommodating container accommodates a plurality of tablets of solid processing agent while the circumference of each tablet is externally contacted with each other; and an accommodating container charging means for detachably holding the accommodating container.

The solid processing agent replenishing device used for the photosensitive material processing apparatus of the present invention comprises: an accommodating container including a discharge opening section capable of discharging the tablets of solid processing agent, and a cover member capable of opening and closing the discharge opening section, wherein the accommodating container accommodates a plurality of tablets of solid processing agent while the circumference of each tablet is externally contacted with each other; an accommodating container charging means for detachably holding the accommodating container; and a supply means for supplying the tablets of solid processing agent discharged from the discharge opening of the accommodating container, to the processing tank.

The solid processing agent replenishing device used for the photosensitive material processing apparatus of the present invention comprises: an accommodating container including a discharge opening section capable of discharging the tablets of solid processing agent, and a cover member capable of opening and closing the discharge opening section, wherein the accommodating container accommodates a plurality of tablets of solid processing agent while the circumference of each tablet is externally contacted with each other; an accommodating container charging means for detachably holding the accommodating container; a housing member including an inlet for receiving the tablets of solid processing agent discharged from the discharge opening of the accommodating container, wherein the inlet is arranged to come in contact with the discharge opening of the accommodating container, and also including an outlet for discharging the processing agent so as to charge it to the processing tank; and a supply means having a processing agent receiving member for moving the processing agent from the inlet to the outlet.

The solid processing agent replenishing device used for the photosensitive material processing apparatus of the present invention comprises: an accommodating container including a discharge opening section capable of discharging the tablets of solid processing agent, and a cover member capable of opening and closing the discharge opening section, wherein the accommodating container accommodates a plurality of tablets of solid processing agent; and an accommodation container charging means capable of moving the accommodation container from the first position before charging the accommodation container to the second position at the time of replenishing the solid processing agent, wherein the accommodating container can be moved from the first to the second position when the discriminating section provided in the accommodating container coincides with the discriminating receiving section corresponding to the discriminating section provided in the accommodating container charging means.

The solid processing agent replenishing device used for the photosensitive material processing apparatus of the present invention comprises: an accommodating container including a discharge opening section capable of discharging the tablets of solid processing agent, and a cover member capable of opening and closing the discharge opening section, wherein the accommodating container accommodates a plurality of tablets of solid processing agent; and an accommodation container charging means capable of moving the accommodation container from the first position before charging the accommodation container to the second position at the time of replenishing the solid processing agent; and a lock means for locking the accommodating container charging means at the first position and for releasing the accommodating container when the discriminating section provided in the accommodating container coincides with the discrimination receiving section provided in the accommodating container charging means corresponding to the discriminating section so that the accommodating container can be moved from the first position to the second position.

In the present invention, the solid processing agent is defined as a tablet in which powder or granules are compressed so as to be formed into a configuration, the section of which is circular.

DETAILED DESCRIPTION OF THE PREFERRED EMBODIMENT

Next, with reference to the accompanying drawings, the photosensitive material processing apparatus of the present invention will be explained as follows. Especially, an example of the solid processing agent replenishing device of the present invention will be explained.

Figure 1:
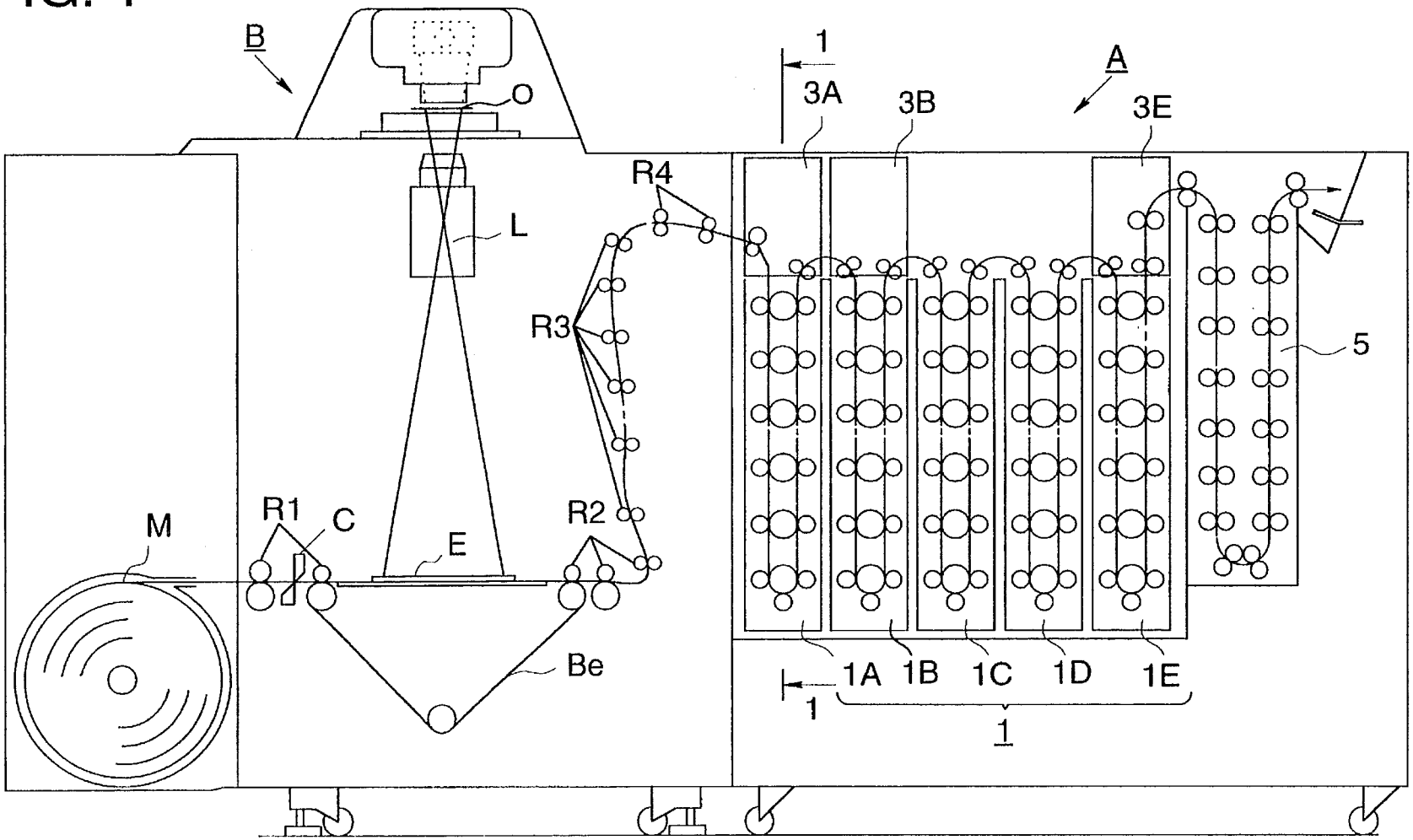
FIG. 1 is a schematic arrangement view of the photosensitive material processing apparatus.

An automatic developing apparatus to which the present invention can be applied will be explained with reference to the accompanying drawings. FIG. 1 is a schematic illustration showing the construction of a photosensitive material processing apparatus (printer processor) in which the automatic developing apparatus A and photographic printer B are integrated.

In FIG. 1, in the left lower portion of the photographic printer B, there is provided a magazine M in which a roll of photographic paper, which is an unexposed silver halide photographic material, is accommodated. The photographic paper is pulled out from the magazine M and conveyed by the feed rollers R1 and cut into a predetermined size by the cutter C. In this way, a sheet of photographic paper can be provided. This sheet of photographic paper is conveyed by the belt conveyance means Be. Then an image of the original O is exposed onto the sheet of photographic paper by a light source and lens L in the exposure section E. The exposed sheet of photographic paper is further conveyed by a plurality of pairs of feed rollers R2, R3 and R4, so that the sheet of photographic paper is introduced into the automatic developing apparatus A. In the automatic developing apparatus A, the sheet of photographic paper is successively conveyed by a roller conveyance means (the reference numeral is not attached to the means) into the color development tank 1A, bleaching and fixing tank 1B and stabilizing tanks 1C, 1D, 1E, wherein these tanks substantially compose a processing tank 1. Due to the foregoing, the sheet of exposed photographic paper is subjected to color development, bleaching and fixing processing and stabilizing processing. After the processing has been completed, the sheet of photographic paper is dried by the drying section 5, and then discharged outside of the apparatus.

In this connection, the one-dotted chain line in the drawing shows a conveyance passage of the silver halide photosensitive material. In this example, the photosensitive material is cut into a sheet and introduced into the automatic developing apparatus A, however, a strip-shaped photosensitive material may be introduced into the automatic developing apparatus A. In this case, the processing efficiency can be enhanced when an accumulator for temporarily stocking the photosensitive material is provided between the automatic developing apparatus A and photographic printer B. Of course, the automatic developing apparatus A of the present invention may be constructed integrally with the photographic printer B, or alternatively the automatic developing apparatus A of the present invention may be constructed separately from the photographic printer B. Of course, the silver halide photosensitive material processed by the automatic developing apparatus A of the present invention is not limited to the exposed photographic paper, but an exposed negative film may be applied to the automatic developing apparatus A of the present invention. The explanation of the present invention is made under the condition that the automatic developing apparatus A includes the color development tank 1A, bleaching and fixing tank 1B and stabilizing tanks 1C, 1D, 1E, wherein these tanks substantially compose a processing tank 1. However, it should be noted that the present invention is not limited to the specific example. The present invention can be applied to an automatic developing apparatus having four tanks of a color developing tank, bleaching tank, fixing tank and stabilizing tank. The color development tank 1A, bleaching and fixing tank 1B and stabilizing tanks 1E are respectively provided with the solid processing agent supply devices 3A, 3B and 3E for supplying the solid processing agent.

Figure 2:
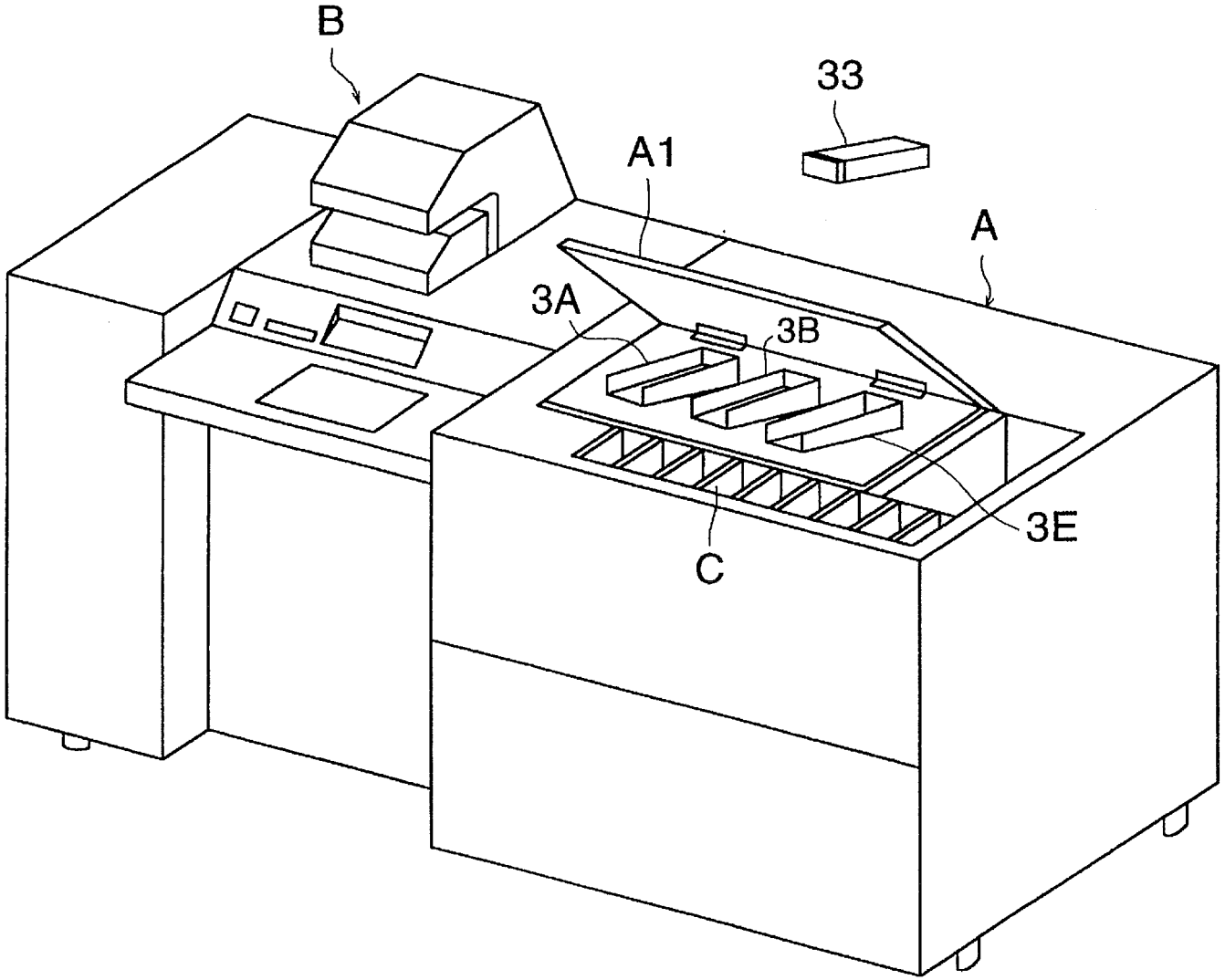
FIG. 2 is a perspective view of the photosensitive material processing apparatus.

FIG. 2 is a perspective view showing the entire photosensitive material processing apparatus in which the automatic developing apparatus A of the present invention, photographic printer B and sorter C are integrally combined. In FIG. 2, the cover A1 of the automatic developing apparatus A is opened upward, and the accommodating container 33 having solid processing agent is inserted into each of the solid processing agent supply devices 3A, 3B, 3E from the left upper to the right lower position in the drawing. After that, they are fixed.

Figure 3:
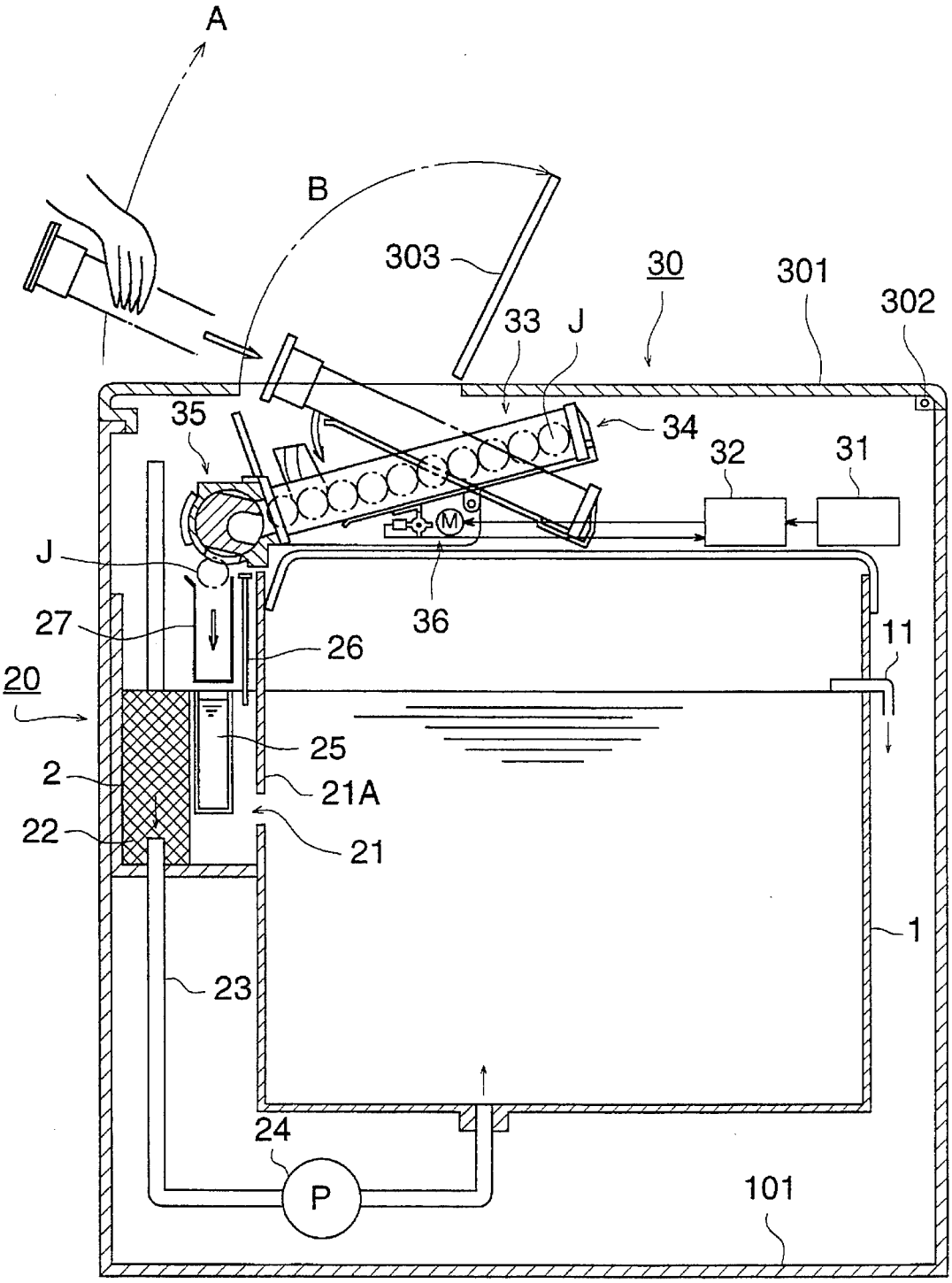
FIG. 3 is a sectional view of the automatic developing apparatus according to the present invention.

FIG. 3 is a sectional view of the processing agent charging section and processing agent supply means of the color development tank A taken on line I—I in FIG. 1. In this case, the construction of the bleaching and fixing tank 1B and that of the stabilizing tanks 1C, 1D, 1E are the same as the construction of the color development tank 1A. Therefore, the explanation of the processing tank 1 can be applied to all tanks of the color development tank 1A, bleaching and fixing tank 1*b*, and stabilizing tanks 1C, 1D, 1E. In this connection, for enhancing the understanding of the invention, the conveyance means for conveying the photosensitive material is omitted in the drawing. In this example, explanations will be made under the condition that tablets of solid processing agent are used.

The processing tank 1 for processing the photosensitive material includes a solid processing agent charging section 20 for supplying tablets of solid processing agent, the solid processing agent charging section 20 being integrally provided outside the separation wall of the processing tank 1, and a constant temperature tank 2. The processing tank 1 and constant temperature tank 2 are separated by a partition wall 21A on which a communicating hole 21 is formed so that the processing solution can be communicated through the communicating hole 21. Since an enclosure or an enclosed portion 25 for receiving the tablets J of solid processing agent is provided in the solid processing agent charging section 20 disposed at an upper position of the constant temperature tank 2, the tablets J of solid processing agent do not proceed to the processing tank 1 in the form of a solid body. In this connection, the enclosure 25 is made of material such as a net or filter so that the processing solution can pass through the enclosure 25, however, the tablet J in the form of a solid body can not pass through the enclosure 25 until it is dissolved.

A cylindrical filter 22 is disposed below the constant temperature tank 2 in such a manner that the cylindrical filter 22 can be replaced. The cylindrical filter 22 removes paper scraps and others in the processing solution. A circulation pipe 23 connected with the suction side of a circulation pump 24 (circulation means) is inserted into the filter 22 passing through the lower wall of the constant temperature tank 2.

As shown in FIG. 3, the circulation system includes the circulation pipe 23 forming a circulation passage of the processing solution, and also includes the circulation pump 24 and the processing tank 1. One end of the circulation pipe 23 is communicated with the delivery side of the circulation pump 24, and the other end penetrates a lower wall of the processing tank 1, so that the circulation pipe 23 is communicated with the processing tank 1. Due to the foregoing construction, when the circulation pump 24 is operated, the processing solution is sucked from the constant temperature tank 2 and discharged into the processing tank 1, so that the discharged processing solution is mixed with the processing solution in the processing tank 1, and then sent to the constant temperature tank 2. In this way, the processing solution is circulated. It is preferable that the circulation times of this circulating processing solution is not less than 0.1 times/min with respect to the tank capacity. In this case, the circulation times C.T is defined as a ratio of an amount of circulating solution in one minute Q to the tank capacity V (C.T=Q/V). More preferably, the circulation times is 0.5 to 2.0. The circulating direction of the processing agent is not limited to the direction shown in FIG. 3, but the direction may be reverse to that shown in FIG. 3.

A waste solution pipe 11 is provided for permitting the processing solution in the processing tank 1 to overflow, so the solution level can be maintained constant and an increase in the components conveyed from other tanks into the processing tank 1 can be prevented. Further, an increase in the components oozing out from the photosensitive material can be prevented.

A rod-shaped heater 26 penetrates an upper wall of the constant temperature tank 2, and is dipped in the processing solution in the constant temperature tank 2. The processing solution in the constant temperature tank 2 and processing tank 1 is heated by this heater 26. In other words, the heater 26 is a temperature regulating means for regulating the temperature of the processing solution in the processing tank 1, so that the temperature can be controlled in an appropriate range, for example, in a range from 20° to 55° C.

A throughput information detecting means 31 is disposed at an entrance of the automatic developing apparatus A, and detects the integrated amount of the processed photosensitive material. This throughput information detecting means 31 is comprised of a plurality of detecting members that are disposed in a transverse direction. This throughput information detecting means 31 detects the width of photosensitive material, and acts as an element to count the detection time. Since the conveyance speed of photosensitive material is previously set in a mechanical manner, the throughput of photosensitive material, that is, the area of processed photosensitive material can be calculated from the width and time information. An infrared ray sensor, microswitch and ultrasonic sensor capable of detecting the width and conveyance time of photosensitive material can be used for this throughput information detecting means 31. A means for indirectly detecting the area of processed photosensitive material may be used for this throughput information detecting means 31. For example, in the case of the printer processor shown in FIG. 1, a means for detecting an amount of printed photosensitive material may be adopted, or alternatively, a means for detecting an amount of processed photosensitive material, the area of which is predetermined, may be adopted. Concerning the detecting time, in this example, detection is carried out before processing, however, detection may be carried out after processing or while the photosensitive material is being dipped in the processing solution. In these cases, the throughput information detecting means 31 may be disposed at an appropriate position so that detection can be conducted after processing or while the photosensitive material is being processed. In the above explanation, detection is conducted on the area of processed photosensitive material, however, the present invention is not limited to the specific example. For example, any values proportional to the throughput of photosensitive material may be adopted. For example, a concentration of the processing solution in the processing tank or a change in the concentration may be used. It is not necessary to provide the throughput information detecting means 31 for each processing tank 1A, 1B, 1C, 1D, 1E, and it is preferable that one throughput information detecting means 31 is provided for one automatic developing apparatus A. Reference numeral 32 is a throughput supply control means for controlling the supply of processing solution in accordance with a signal sent from the throughput information detecting means 31.

The solid processing agent replenishing device 30 used for the photosensitive material processing apparatus of the present invention is disposed above the photosensitive material processing apparatus, and comprises an accommodating container 33, accommodating container charging means 34, supply means 35 and drive means 36, wherein the solid processing agent replenishing device 30 is tightly closed by an upper cover 301. The upper cover 301 is rotatably connected with a main body 101 accommodating the processing tank 1 and constant temperature tank 2, through a support shaft 302 attached to the back of the main body. The upper cover 301 is lifted upward as shown by a one-dotted chain line in FIG. 3, so that the front and upper portions of the apparatus can be widely opened. In this way, inspection of the solid processing agent replenishing device 30, and replacement of the filter 22 can be easily conducted.

A skylight 303 is rotatably connected with a portion of the upper surface of the upper cover 301. When the skylight 303 is opened as illustrated by a one-dotted chain line B in the drawing, the accommodating container 33 is attached or replaced.

Figure 4:
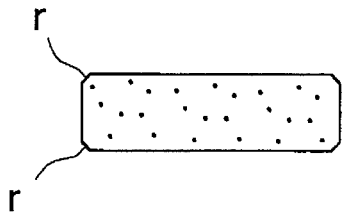
FIGS. 4(A) to 4(E) are sectional views and FIG. 4(E) is a perspective view showing various configurations of the tablet type solid processing agent .
Figure 4:
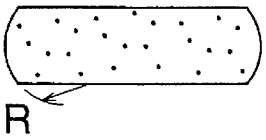
Figure 4:
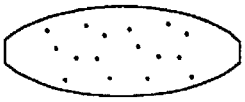
Figure 4:
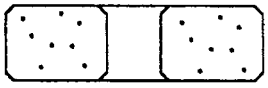
Figure 4:
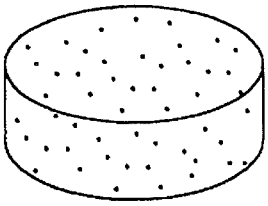

FIGS. 4(A) to 4(E) show various configurations of the tablet type solid processing agent J. FIG. 4(A) is a sectional view of the cylindrical flat tablet type solid processing agent J, wherein the configuration is circular and the corners are chamfered by the radius of curvature of r. FIG. 4(E) is a perspective view of the tablet type solid processing agent J. FIG. 4(B) is a sectional view of the flat tablet type solid processing agent J, wherein the configuration is circular, and the upper and lower surfaces are flat, and the circumferential surface is formed convex by the radius of curvature of R. FIG. 4(C) is a sectional view of the tablet type solid processing agent J, wherein the configuration is flat, and the upper and lower surfaces are formed spherical. FIG. 4(D) is a sectional view of the tablet type solid processing agent J, wherein the configuration is a doughnut-shape having a hole at the center.

Figure 5:
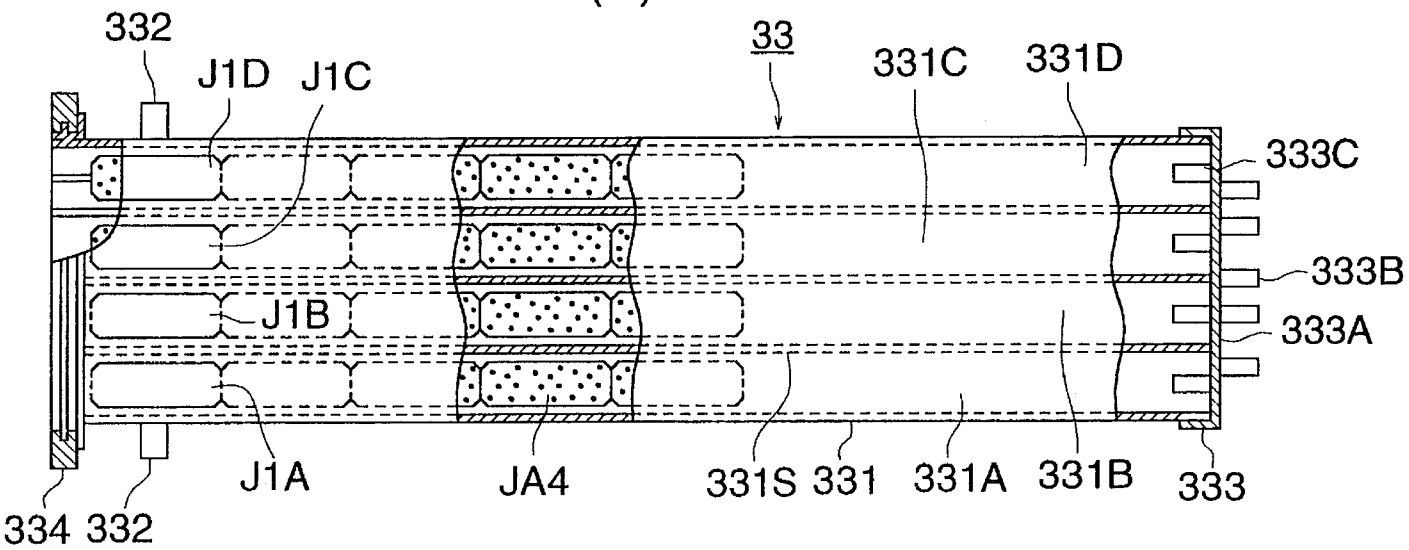
FIG. 5(A) is a plan view and FIG. 5(B) is a side view of the accommodating container for accommodating the solid processing agent described above.
Figure 5:
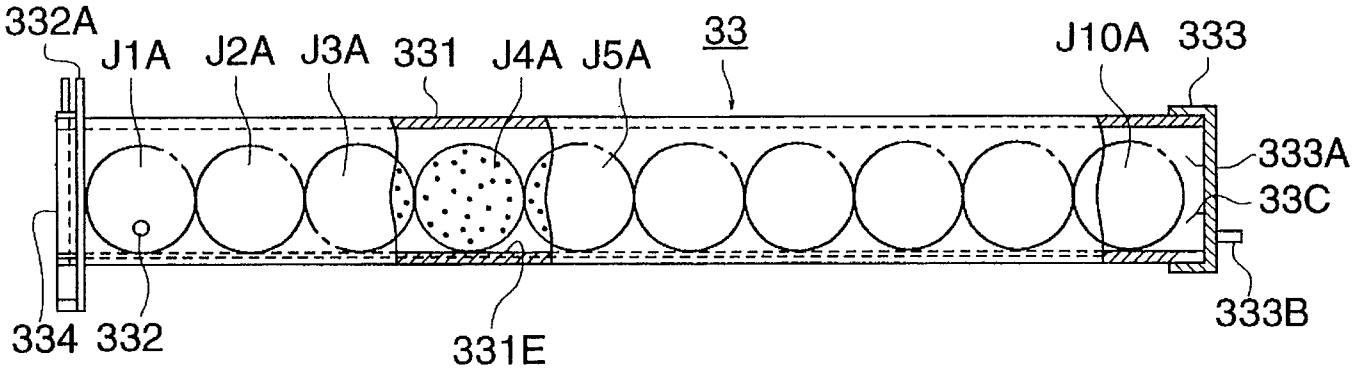
Figure 6:
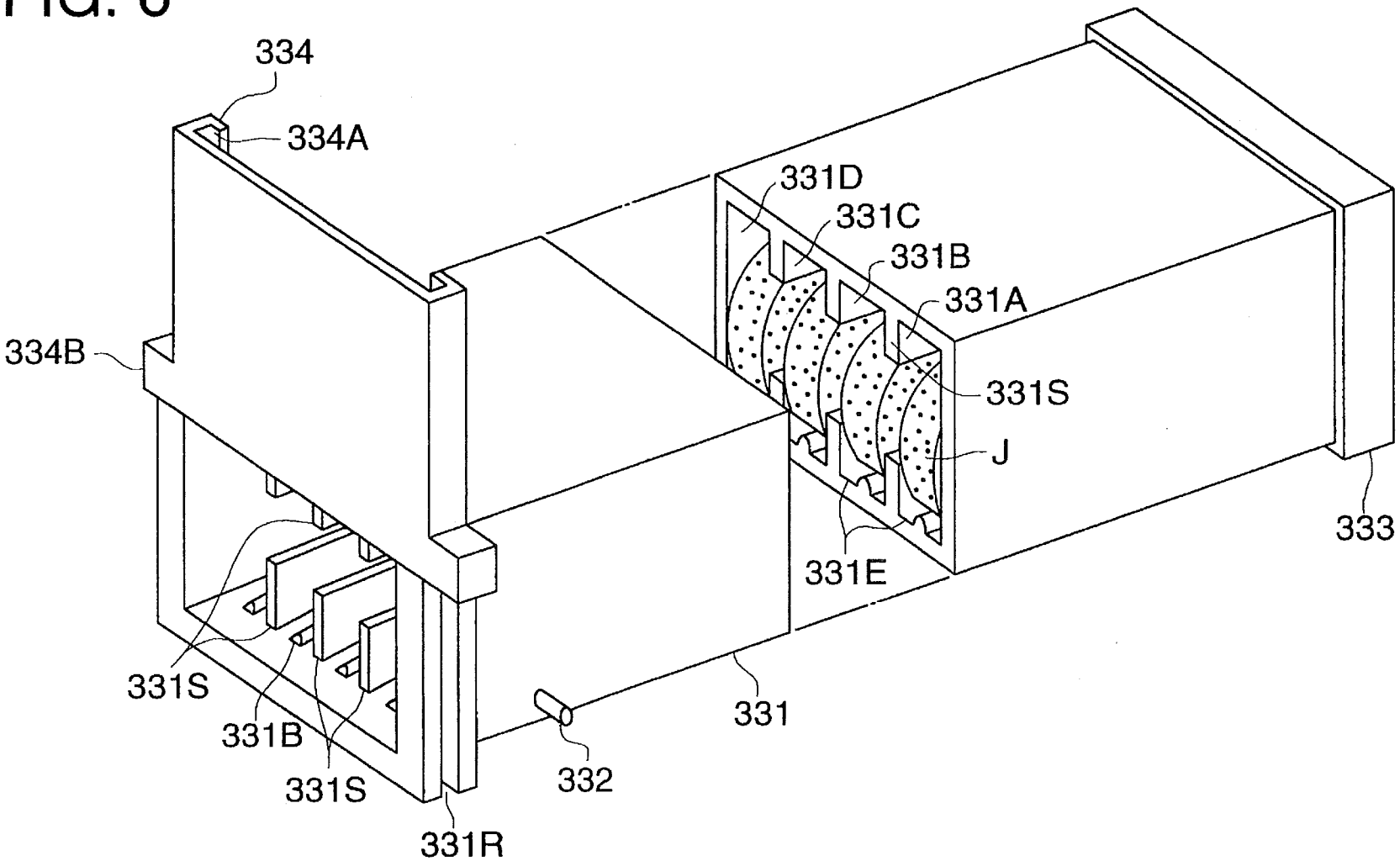
FIG. 6 is a perspective view of the above accommodating container.
Figure 26:
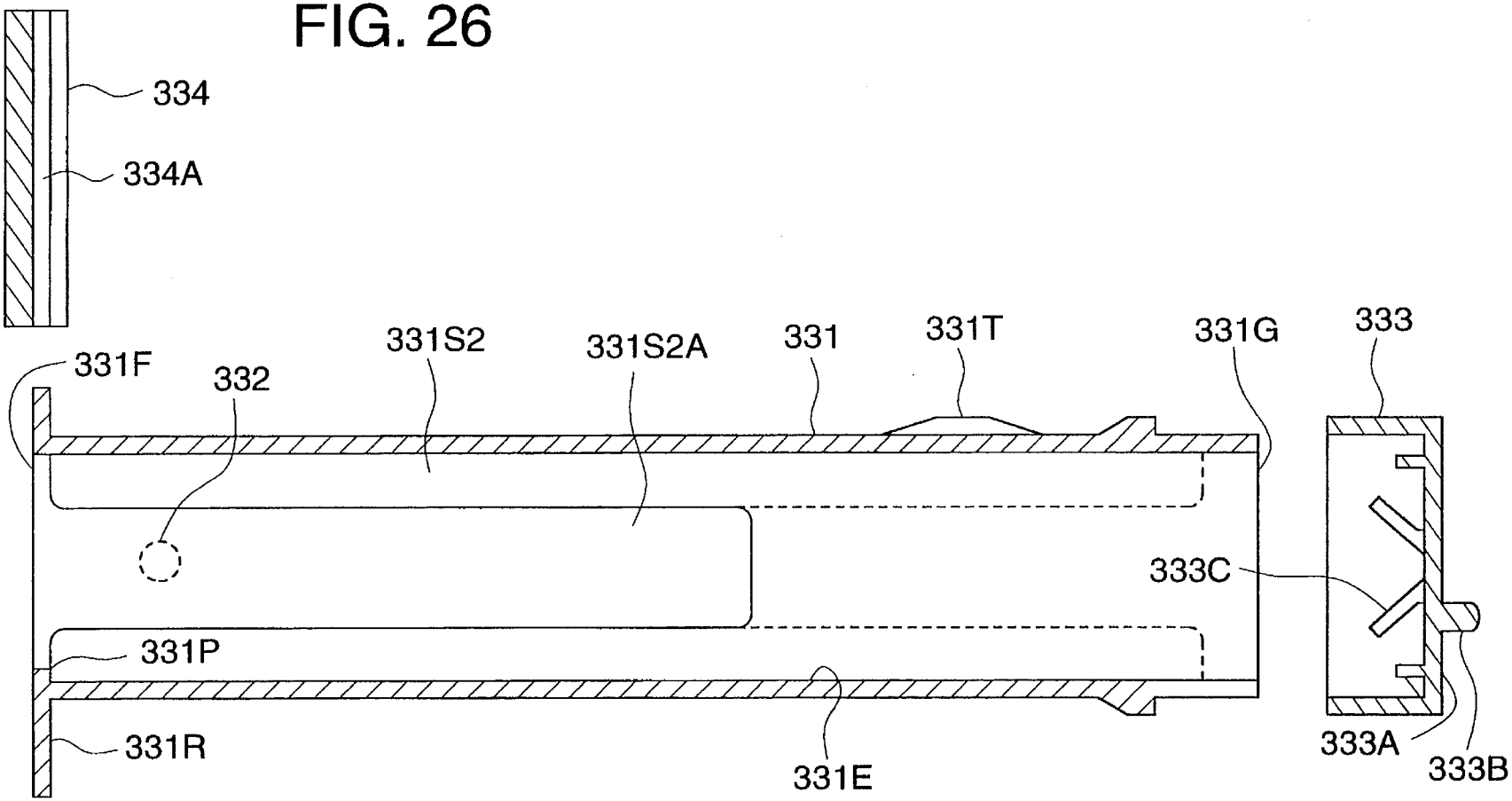
FIG. 26 is an exploded sectional view of an example of the solid processing agent accommodating container of the present invention.

FIGS. 5(A) and 5(B) are views showing the accommodating container (cartridge) 33 for accommodating the tablet type solid processing agent J. FIG. 5(A) is a plan view including a partially cutaway view. FIG. 5(B) is a side view of the accommodating container 33. FIG. 6 is a perspective view of the accommodating container 33, wherein a portion is partially cutaway. FIG. 26 is an exploded sectional view of the accommodating container 33.

The accommodating container 33 includes: a container main body 331, the configuration of which is like a hollow square hole, the container main body 331 having a discharge opening 331F through which the tablet of solid processing agent can be discharged; a cap member 333 for closing the other opening 331G of the container main body 331; and a sliding cover 334 capable of being moved upward and downward, wherein the sliding cover 334 slides on a rail 331R of the container main body 331.

Figure 23:
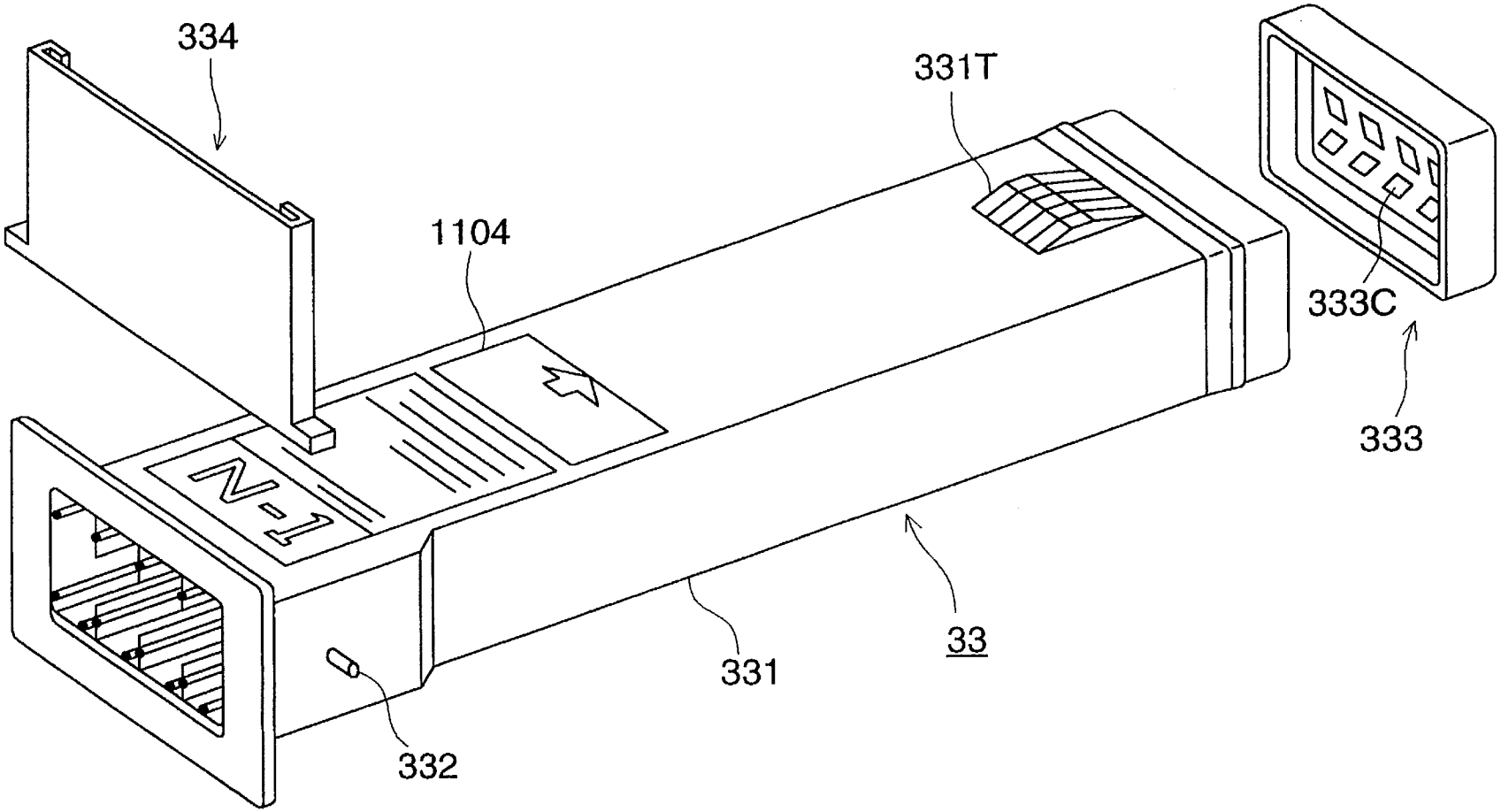
FIG. 23 is an overall perspective view of the accommodating container.

In this case, an approximately square pole is not necessarily a precise rectangular parallelopiped. It includes a container, the configuration of which is shown in FIG. 23, wherein a flange to engage with a shutter is attached to an opening 331F of the container.

Three sets of partition walls 331S are integrally fixed inside the container 331, so that the inside of the container 331 is divided into four chambers 331A, 331B, 331C, 331D. In each chamber, the approximately cylindrical tablets of solid processing agent J are longitudinally accommodated under the condition that each outer circumference is externally contacted with the inside wall of the chamber. Specifically, 10 tablets of solid processing agent J1A to J10A are accommodated in the first chamber 331A, and 10 tablets of solid processing agent J1B are accommodated in the second chamber 331B. In the same manner, the tablets J1C and J1D are respectively accommodated in the chambers As described above, the outer circumference of each tablet of solid processing agent is externally contacted with each other in the chamber. Accordingly, the contact surface of the tablet of solid processing agent can be reduced as small as possible. Therefore, even when the solid processing agent absorbs moisture, the adhesion caused between the tablets of solid processing agent can be minimized. Since the rows of tablets of solid processing agent are divided by the partition walls 331S, the adhesion between the different rows can be prevented. In the example, the accommodating container is formed into a rectangular parallelopiped, however, the present invention is not limited to the specific example. As long as the outer circumference of each tablet of solid processing agent is externally contacted, any container configurations may be employed. For example, the tablets of solid processing agent is not necessarily alined on a line, but they may be arranged on a curve or spiral. From the viewpoint of manufacture and handling of the container, a rectangular parallelopiped container is preferably used. The partition wall 331S is not necessarily continued from the bottom to the upper surface of the container. As long as each tablet of solid processing agent J is externally contacted with each other on the outer circumference and aligned on a longitudinal row, any height of the partition wall may be adopted.

In order to enhance the mechanical strength and to prevent the occurrence of distortion of the container, and further in order to improve the manufacturing efficiency, it is preferable that the partition wall 331S is continued from the bottom to the upper surface.

Figure 25:
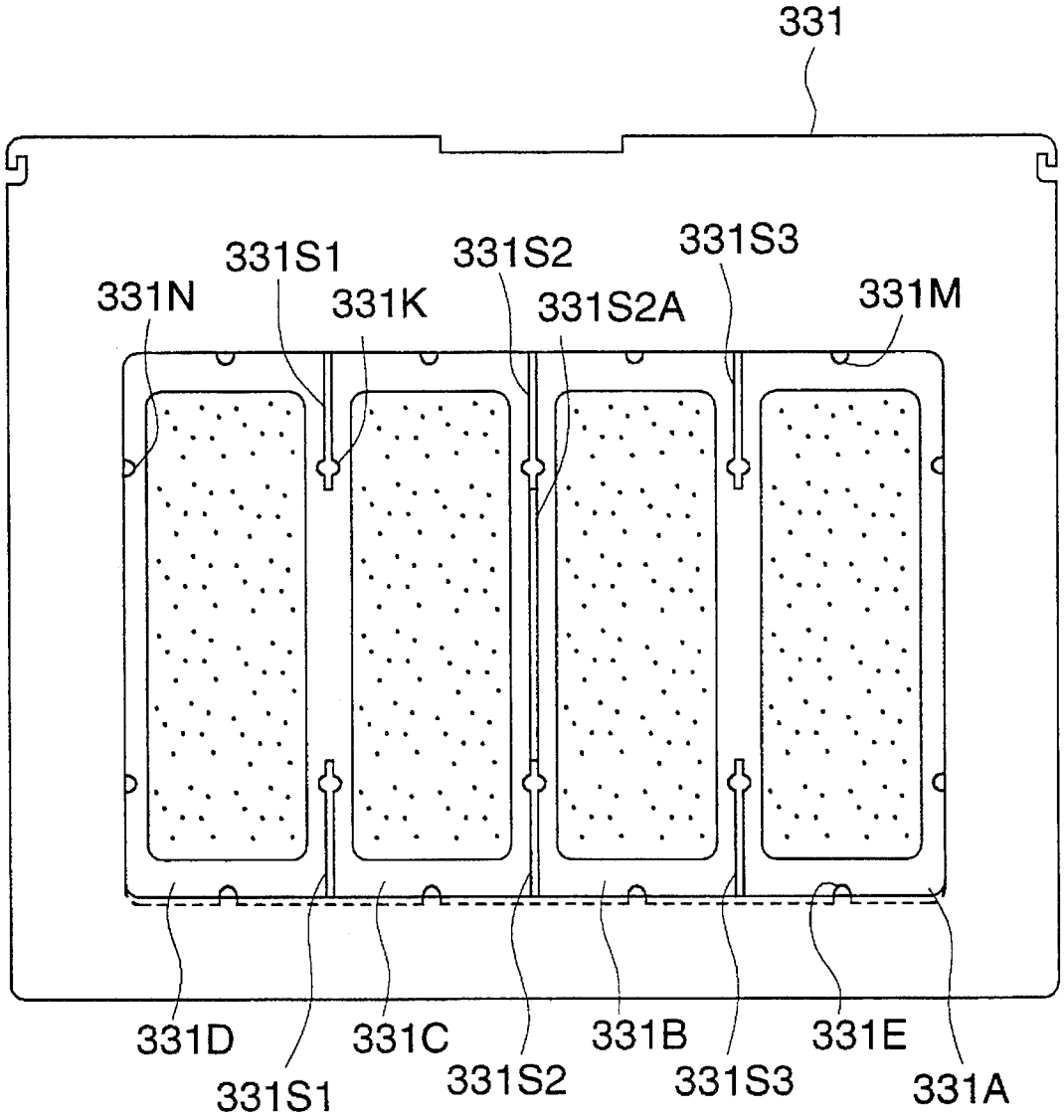
FIG. 25 is a front view of an example of the solid processing agent accommodating container of the present invention, wherein the view is taken from the side of the discharge opening.

FIG. 25 is a front view showing an example of the container main body 331, wherein the view is taken from the side of the discharge opening 331F.

The first partition wall 331S1 and the third partition wall 331S3 are formed into vertical walls respectively protruding from the top and bottom portions of the container main body 331. Therefore, an intermediate portion of the partition wall is cut away, and the upper and lower walls are protruded being formed into a pair. The partition wall 331S2 disposed at the center is formed into a vertical wall continued from the top to the bottom portions of the container main body 331. While the mechanical strength of the container main body 331 is maintained, a cutout portion 331S2A is formed in the central portion of the partition wall 331S2 from the discharge opening 331F to the central portion of the container main body 331 with respect to the longitudinal direction. Each partition wall 331S1, 331S2, 331S3, 331S4 is formed thin and resilient. Projections 331K are formed on both surfaces of the partition wall. These projections 331K are linearly contacted with the outer surface of the tablets of solid processing agent J, so that the frictional resistance can be reduced when the tablets of processing agent J are discharged.

A projection 331E is projected from the bottom surface of each chamber of the container main body 331. This projection 331E comes into contact with a point of the outer circumferential surface of the tablet of solid processing agent J, so that the tablet can be easily moved, and powder separated from the tablet of solid processing agent J drops from the top of the projection 331E. Separated powder accumulates in a groove formed under the projection 331E. Accordingly, even when the powder is deposited in the groove, no problems are caused because the tablet of solid processing agent J moves on the projection 331E. The number of this projection 331E may be not less than 2. The projection 331E may be a groove on the contrary to the projection.

On the inner wall surfaces of the container main body 331, not only the projection 331E formed on the bottom surface but also the projection 331M is formed on the top of the inner surface, and also the projections 331N are formed on the inner surface on both sides. Therefore, an area of the surface of the solid processing agent J where it is contacted with the inner surface of the container main body 331 can be remarkably reduced, so that the contact resistance of the solid processing agent J can be reduced when it is discharged. Due to the foregoing, the solid processing agent J can be stably taken out from the accommodating container 33.

It is preferable that the projections 331E, 331M, 331N and the projection 331K are formed approximately in parallel with the longitudinal direction of the container main body 331. The projections are preferably formed at positions where the solid processing agent J does not enter between the projections, and it is preferable that the number of the projections is as small as possible. In order to meet the demand described above, the width of the projection is preferably 1/100 to 1/10 of the diameter of the tablet J, and the height of the projection is preferably 1/100 to 1/10 of the diameter of the tablet J. It is preferable that the section of the projection is approximately semicircular or trapezoidal, and the corners are chamfered so that the corners can not damage the circumferential surface of the tablet of solid processing agent J.

It is preferable that a projection 331P is provided at a position close to the discharge opening 331F of the container main body 331 in the longitudinal or the lateral direction of the discharge opening 331F as shown in FIG. 26. Due to the foregoing construction, powder of the solid processing agent generated during conveyance is received by the projection 331P and accumulated there. In this way, powder is prevented from being conveyed to the next process, and the entire system can be stabilized.

In order to form the projection 331P, a different member may be attached to the container main body 331, however, taking the productivity into consideration, it is preferable that the projection 331P is formed integrally with the container main body 331.

In the case where the container is manufactured by means of injection molding, the projection 331P becomes an undercut portion. However, when polyethylene resin is used for the material, it is possible to manufacture the projection 331P integrally with the container main body 331. In this case, it is preferable that the height of the projection 331P is determined to be in a range from 0.3 to 2.0 mm.

In the container 33 for accommodating the processing agent, a plurality of substantial spaces are formed when the projections are provided on the inner surface of the container main body. Therefore, the configuration of a metallic molding core is long and slender. Accordingly, in order to prevent the core from collapsing in the process of injection molding so as to conduct the molding operation smoothly, at least one cutout portion is preferably provided in the continuously formed projection. In this cutout portion, the metallic core is connected, so that the mechanical strength can be enhanced. For this reason, when at least one cutout portion is provided in the continuously formed projection of the container, a plurality of substantial spaces can be formed, so that the metallic core is less susceptible to collapse, and the container can be formed in a good condition.

A rail 332A is provided on both outer sides of the discharge opening, and slidably engages with grooves 334A formed on both sides of the sliding cover 334. Projections 334B projecting from both lower ends of the sliding cover 334 engage with opening and closing regulating members 355 described later with regard to FIG. 7, so that the sliding cover 334 can be automatically closed. The opening and closing regulating member 355 prevents the sliding cover 334 from being disengaged from the rail 332A. The cover for opening and closing the discharge opening is not limited to the sliding cover. As long as the cover can open and close the discharge opening so as to prevent moisture from entering the accommodating container, any types cover may be adopted. In this example, the sliding cover is used, and a mechanism for replenishing the processing agent from the accommodating container to the processing tank is shown as an example. However, it should be noted that the opening and closing regulating member 355 is not limited to the specific example, and a change in design may be made in accordance with the configuration of the cover.

Guide pins 332 are protruded from both sides of the container main body 331, and engages with guide grooves 341D of the accommodating container charging means 34 described later.

The back surface 333A of the cap member 333 is pushed by a resilient pushing member 343C of the accommodating container charging means 34 described later, so that the accommodating container 33 is pressed against a reference surface of the supply means 35. When a leaf spring 345 pushes a guide pin 332 of the accommodating container 33, the accommodating container 33 is pressed against the reference surface. A plurality of discriminating projections 333B are integrally provided on the back surface 333A of the cap member 333, and a wrong accommodating container 33 in which a different processing agent is accommodated is prevented from being mounted.

For the purpose of protecting the tablets of solid processing agent J in the accommodating container 33 from being damaged by oscillation and shock during the transportation, a cushion member 333C may be provided inside of the back surface 333A of the cap member 333. It is preferable that the cushion member 333C is formed integrally with the back surface 333A.

A portion of the cushion member 333C (shock absorbing member) where the cushion member 333C comes into contact with the solid processing agent, is preferably formed into a curved configuration for absorbing shock and oscillation effectively. Due to the foregoing construction, a cleaning mechanism for removing powder of the solid processing agent is not required.

Figure 20:
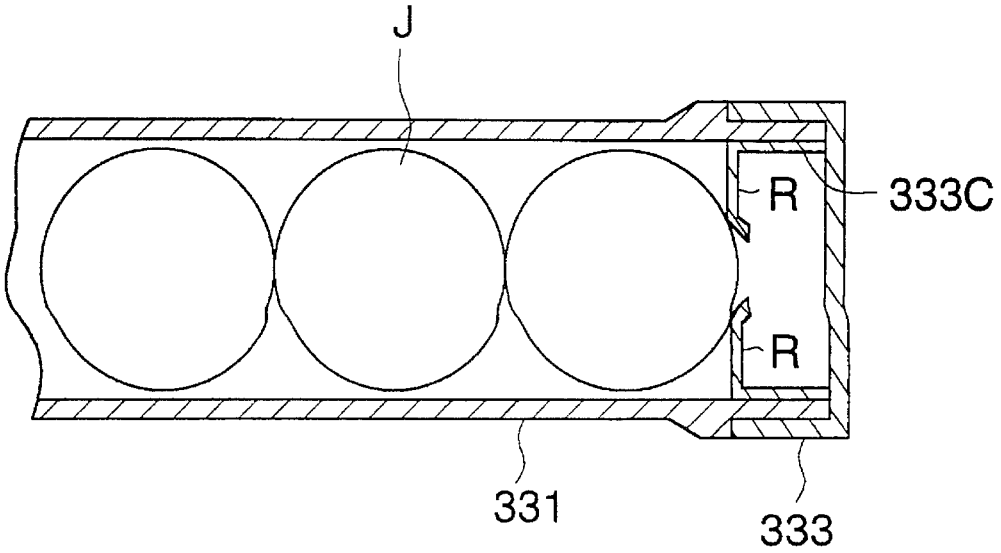
FIGS. 20(A) and 20(B) are sectional views showing a portion close to the shock absorbing member of the rear cover.
Figure 20:
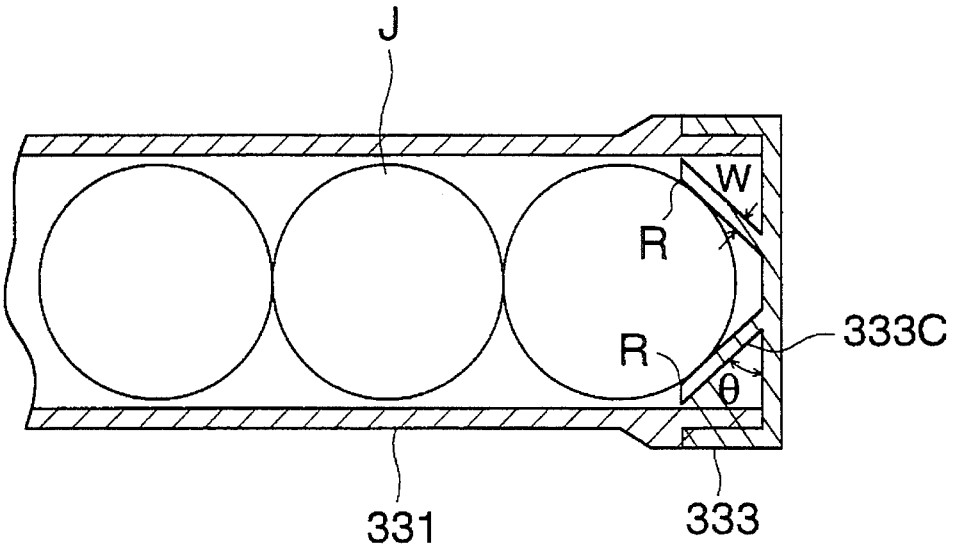

FIG. 20 is a sectional view showing the cushion member 333C and the relating parts.

FIG. 23 is an overall perspective view of the accommodating container.

An example of the configuration of the shock absorbing member 333C is shown in FIG. 20(A). In this case, consideration is given to the deviation of the size of the solid processing agent J, the change in the size caused when the solid processing agent J has absorbed water, the fluctuation of formation of the accommodating container 33, the change in the size caused when the environmental temperature of the accommodating container 33 has changed (expansion at high temperatures and shrinkage at low temperatures), and the fluctuation of assembly of the accommodating container 33. According to the results of the consideration described above, a region in which the cushion member is effectively activated is necessarily wide. Therefore, the configuration shown in FIG. 20(A) is preferable, and the configuration shown in FIG. 20(B) is more preferable from the viewpoint of absorbing shock and oscillation during conveyance of the accommodating container.

For example, in the case where 10 tablets are provided into each space of the container, the overall length of which is 308 mm, the following circumstances can be considered.

Deviation of the size of a tablet of solid processing agent: 0.2 mm/tablet×10 tablets=2 mm Change in the size of a tablet of solid processing agent caused when it absorbs water: 2 mm/10 tablets Fluctuation of formation of the accommodating container of the tablets of solid processing agent: 0.8 mm Change in the size of the accommodating container of the tablets of solid processing agent caused by the environmental temperature: 2 mm Fluctuation of assembly of the accommodating container: 0.5 mm Accordingly, the fluctuation of 7.3 mm may be caused at the maximum. In order to absorb this fluctuation in the process of conveyance, the shock absorbing member 333C is required.

In the case of the shock absorbing member 333C illustrated in FIG. 20(B), in order to simplify the mold structure of injection molding, the shock absorbing member 333C is preferably formed using a mold from which the shock absorbing member 333C is forcibly drawn out.

In this case, in order to improve the releasing property from the mold, it is preferable that the width L is 2 to 6 mm, the thickness W is 0.5 to 2.0 mm, and the angle θ formed by the cap bottom is not less than 30°.

A contact surface of the shock absorbing member 333C where the shock absorbing member 333C comes into contact with the solid processing agent J is preferably chamfered so as to eliminate the corner.

At a position in the processor where the solid processing agent is received, tends to be in a condition of high temperature and humidity. Accordingly, it is necessary to take out a predetermined amount of solid processing agent from the accommodating container even under the condition of high temperature and humidity.

The solid processing agent has a water absorbing property. Accordingly, under the condition shown in FIGS. 5(A) and 5(B) in which a plurality of tablets of solid processing agent are accommodated in each space in the accommodating container 33, water enters the inside through the discharge opening of the accommodating container, so that the solid processing agent gradually absorbs water. In this case, an amount of water absorption is not equal with respect to all tablets of solid processing agent, but the tablet of solid processing agent J close to the opening of the accommodating chamber 33 absorbs water preferentially. In other words, an amount of water absorption of the first tablet (J1) closest to the opening is the largest, and that of the second tablet (J2) adjacent to J1 is the second largest. Due to the foregoing, amounts of water absorption of the tablets of solid processing agent J3 to J10 are small. Accordingly, when the sectional area of the solid processing agent J is determined to be close to the sectional area of the substantial space of the container 33 in a range in which the solid processing agent can be discharged from the container, the gap can be reduced, so that the amount of water absorption can be minimized. Consequently, it is preferable that a space for accommodating the solid processing agent formed in a portion close to the discharge opening of the accommodating container is wider than other accommodating spaces.

Concerning the accommodating container, the configuration of which is formed into an approximately rectangular parallelopiped, dimensions of the solid processing agent accommodating region in the accommodating container can be described as follows. Dimensions of a section of the accommodating container inner wall approximately perpendicular to the solid processing agent discharging direction, are larger than those of a section located on the upstream side in the solid processing agent discharging direction.

Figure 21:
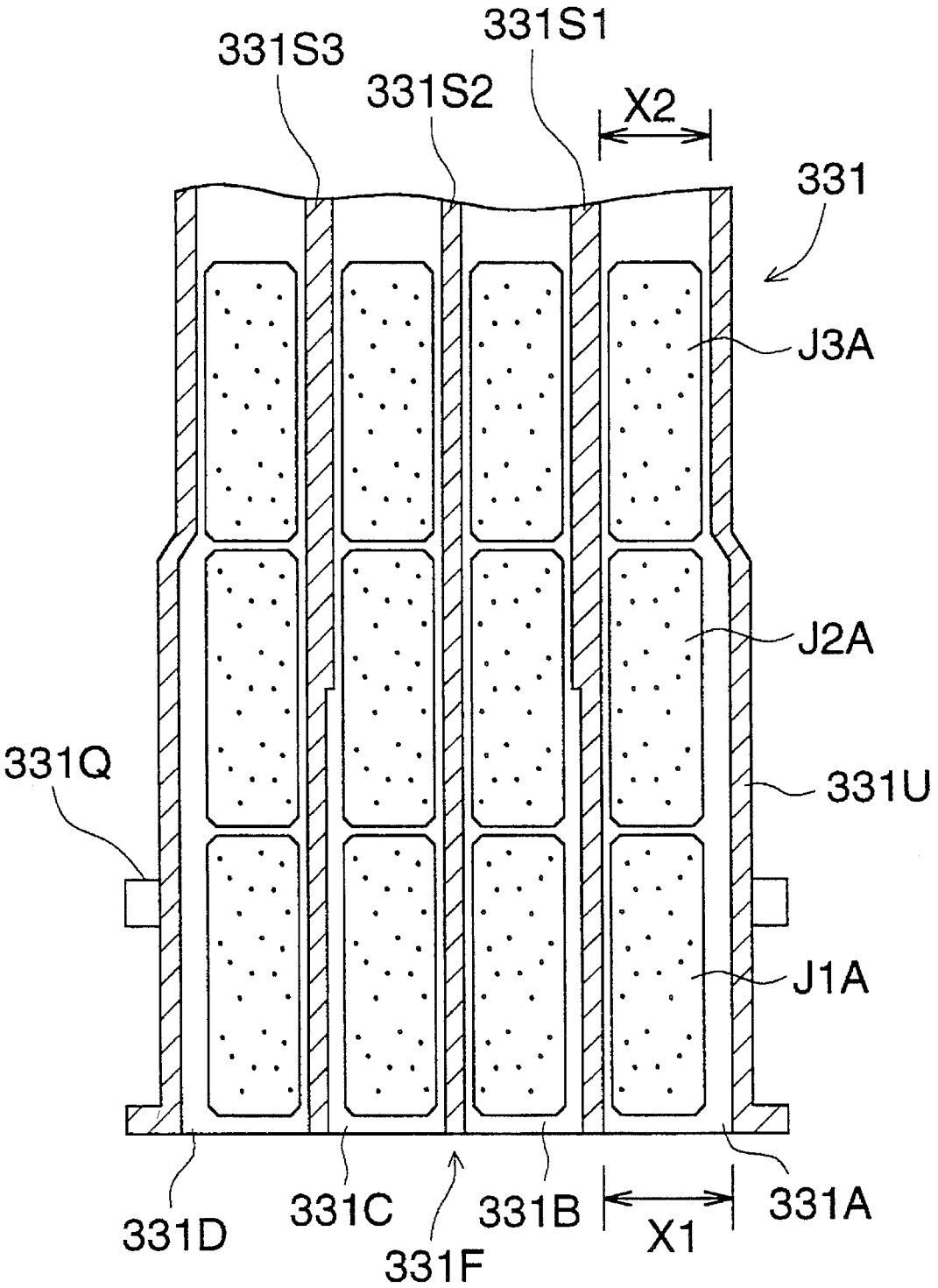
FIG. 21 is a sectional view showing a portion close to the discharge opening of the container main body.

FIG. 21 is a sectional plan view of the container main body 331.

Figure 22:
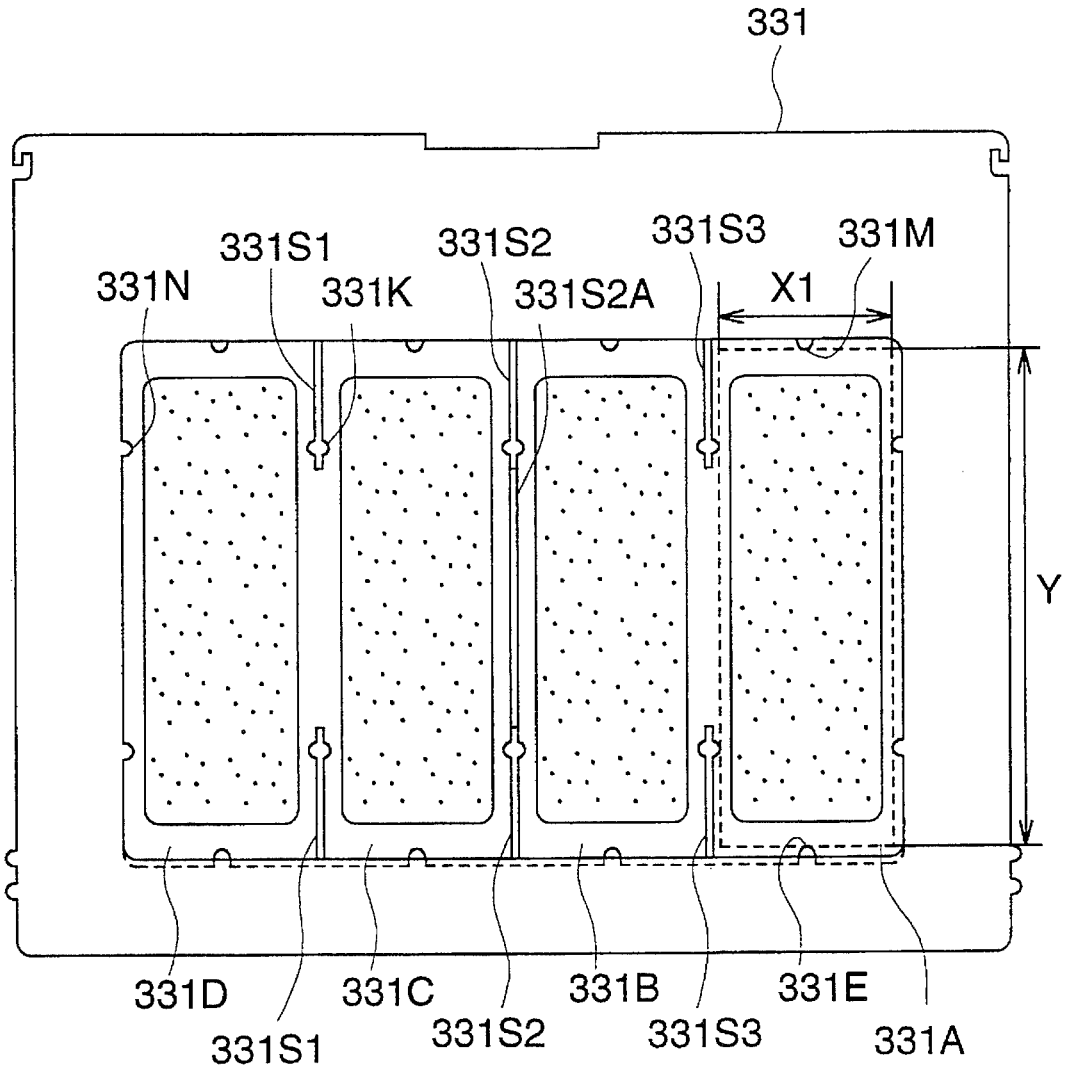
FIG. 22 is a front view taken from the discharge opening of the container main body.

Referring to FIGS. 21 and 22, in the first chamber 331A formed between the partition wall 331S1 and the inner wall of the container main body 331, dimensions for restricting the solid processing agent accommodating region are determined as follows. The size X1 of the short side of the section of the solid processing agent accommodating region in which two tablets (J1A, J2A) are accommodated, is determined to be larger than the size X2 of the short side of the section of the solid processing agent accommodating region in which the third tablet and after that (J3A to J10A) are accommodated. That is, X1>X2. The value of X1 is determined in such a manner that the swelling in a predetermined period of time of the processing agent tablet J was experimentally found. The size Y1 of the long side of the section is determined in the same manner. The size of the inner wall close to the discharge opening 331F may be extended in such a manner that the outer wall 331U of the container main body 331 shown in FIG. 21 is extended. Alternatively, the size of the inner wall close to the discharge opening 331F may be extended in such a manner that the thickness of the projections 331K, 331M, 331N of the partition walls 331S to 331S3 substantially forming the spaces in the container, is changed at a position close to the discharge opening. Also, the inner wall portion of the size X1 in the container main body 331 may be tapered so that a core can be easily taken out in the process of injection molding. In general, in the case of injection molding, wall surfaces must be tapered for the release from the mold. Utilizing these tapered surfaces, the size X1 of the solid processing agent accommodating container at a position close to the discharge opening can be made larger than the size X2 at a position separated from the discharge opening of the container main body 331. In this case, when the surfaces are tapered, the productivity of the container can be enhanced, and also the accuracy of the container can be enhanced. In this case, the regulating sizes for regulating the solid processing agent accommodating region are defined as the sizes of the inside of the accommodating container for substantially determining the accommodating space for accommodating the solid processing agent tablets J. Therefore, the portions 331N, 331E, 331K shown in FIG. 22 coming into contact with the tablets J are not included in the seizes of the solid processing agent accommodating region. FIG. 23 is a perspective view of the overall accommodating container 33 to which the embodiment shown in FIGS. 21 and 22 is applied.

The accommodating container 33 is made of resin or cardboard material subjected to moisture-proof processing.

Examples of usable synthetic resins for the accommodating container 33 are: polyethylene (both high and low pressure methods may be used), polypropyrene (both elongation and non-elongation types may be used), polyvinyl chloride, polyvinyl acetate, nylon (both elongation and non-elongation types may be used), polyvinylidene chloride, polystyrene, polycarbonate, vinylon, Ebaru, polyethylene terephthalate (PET), other polyester, acetic rubber, acrylonitrile butadiene copolymer, and epoxy-phosphoric acid resin (polymers described in Japanese Patent Publication Open to Public Inspection Nos. 63037/1988 and 32952/1982). Among the synthetic resins, polyethylene is preferably used. When polyethylene is used, the container of the present invention can be easily formed, and the tablets of solid processing agent are seldom damaged, and further the recycling characteristics are excellent. Furthermore, when polyethylene is used, the following requirements for the container made of synthetic resin are easily satisfied: the oxygen permeability is not more than 50 $ml/m^2$.24 hr.atm in ASTMD 1434-58, and more preferably the oxygen permeability is not more than 30 $ml/m^2$.24 hr.atm.

The material should be selected so that the water transmission amount can be not more than 30 $ml/m^2$.atm.24 hrs (25° C.) and preferably the water transmission amount can be not more than 10 $ml/m^2$.atm.24 hrs. When the material is provided with a moisture-proof property, the preservation property of the accommodated solid processing agent can be enhanced. It is preferable that the construction members are made of approximately the same synthetic resin mold, the shock resistance property of which is high.

From the viewpoint of the effect of the present invention, the wall thickness of the container made of synthetic resin of the present invention is 10 to 3000 μm, and preferably 200 to 2000 ||m.

Figure 24:
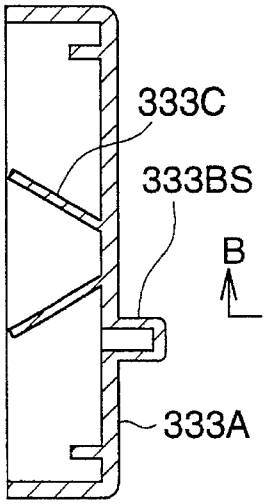
FIG. 24(A) is a front view and FIGS. 24(B) and 24(C) are sectional views of an example of the fixed cover (rear cover) of the solid processing agent accommodating container of the present invention.
Figure 24:
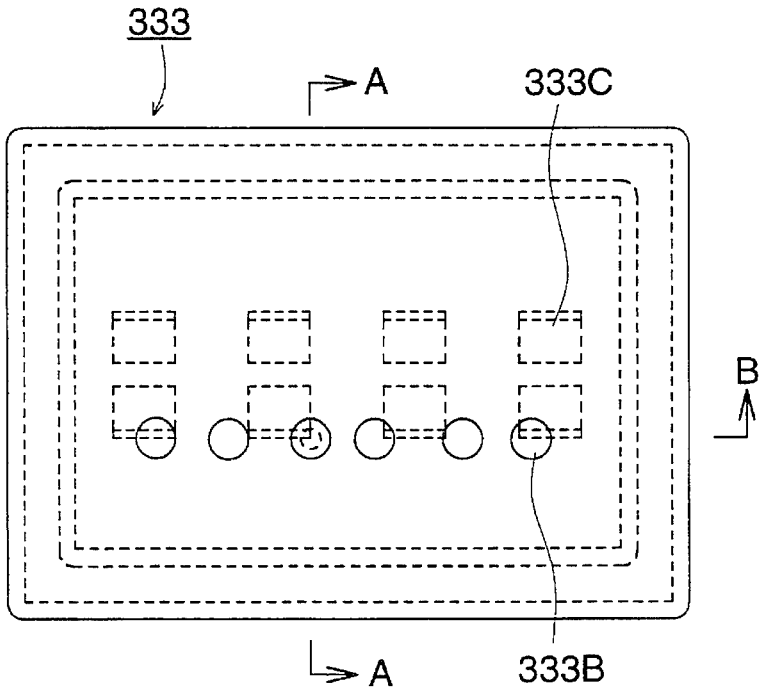
Figure 24:
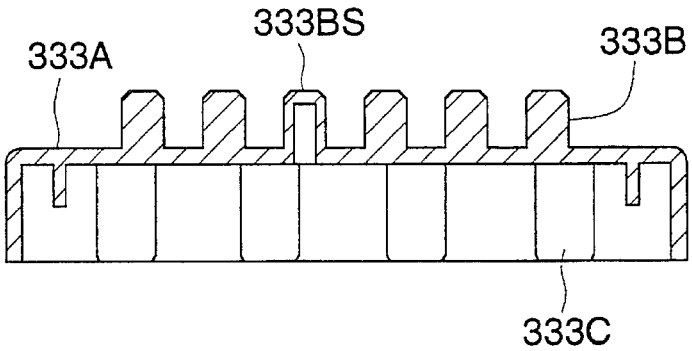

FIG. 24(A) is a front view of the fixed cover (rear cover) 333. FIG. 24(B) is a sectional view taken on line A—A. FIG. 24(C) is a sectional view taken on line B—B. A plurality of discriminating projections 333B are integrally formed in the back surface 333A of the fixed cover 333. The configuration of this discriminating projection 333B is not particularly limited, however, a simple configuration, for example, a circular pole or a square pole is preferable from the viewpoint of manufacture. The number of the plurality of discriminating projections 333B is not limited to 6 as illustrated in the drawing, and an appropriate number may be selected depending on the type of the solid processing agent tablet. When the number and position of the plurality of discriminating projections 333B are appropriately determined, the type of the solid processing agent tablets can be discriminated. On the other hand, an engaging hole is formed at a position corresponding to the discriminating projection 333B in the accommodating container charging means 34 of the solid processing agent replenishing device 30 which will be described later. When the discriminating projection 333B is inserted into the engaging hole, the accommodating container 33 can be discriminated and its position can be regulated.

As the plurality of discriminating projections (misoperation preventing pins, which will be referred to as pins hereinafter) 333B are disposed being separated from the center line, it is impossible to reversely attach the accommodating container 33 to the container holding member 343. The number and positions of the plurality of pins 333B are made to be different according to the type of the solid processing agent tablets J. Some of the pins 333B are removed from the 5 pins 333B, and the type of the solid processing agent tablets J can be discriminated by at least 2 predetermined remained pins 333B so that the misoperation can be prevented.

When the discriminating projection 333B are tapered or chamfered, the discriminating projection 333B can be easily inserted into the engaging holes of the charging device. After the discriminating projections 333B have been inserted into the engaging holes of the charging device, the position can be highly accurately regulated without causing any clearance. When a plurality of discriminating projections 333B are provided, positional regulation can be made more accurately than one discriminating projection.

Among the plurality of discriminating projections 333B, there is provided a specific discriminating projection 333BS used for discriminating between the domestic and the oversea use. When this specific discriminating projection 333BS is made hollow, it is possible to prevent an apparatus made by the piracy from circulating in the domestic market. For example, one of the plurality of discriminating projections 333B is determined to be a projection for discriminating between the domestic and oversea use. In this case, an apparatus for oversea use is provided with the projection 333B, and an apparatus for domestic use is not provided with the projection 333B. Engaging holes of the charging means 34 of the solid processing agent replenishing device 30 are arranged corresponding to the above discriminating projections 333B. In the case where an apparatus for oversea use is operated in this country, the specific projection 333BS for discriminating between the domestic and oversea use must be cut. Since this specific projection 333BS is hollow, a through-hole is made on the back surface 333A of the fixed cover 333 when the specific projection 333BS is cut. Accordingly, the atmosphere enters the inside of the accommodating container 33, so that the moisture-proof property is deteriorated. Since the solid processing agent has a water absorption property, its quality is deteriorated. In this way, the apparatus for oversea use can not be used in the domestic market by the action of the specific discriminating projection 333BS.

When a projection 331T for preventing the misoperation is provided on the upper surface of the accommodating container 33 as illustrated in FIG. 23, the misoperation of the accommodating container 33 can be prevented when it is attached to the apparatus. Also, when a label 1104 for indicating a correct inserting direction of the accommodating container is stuck onto the upper surface of the accommodating container 33, the misoperation of the accommodating container 33 can be prevented when it is attached to the apparatus.

Figure 27:
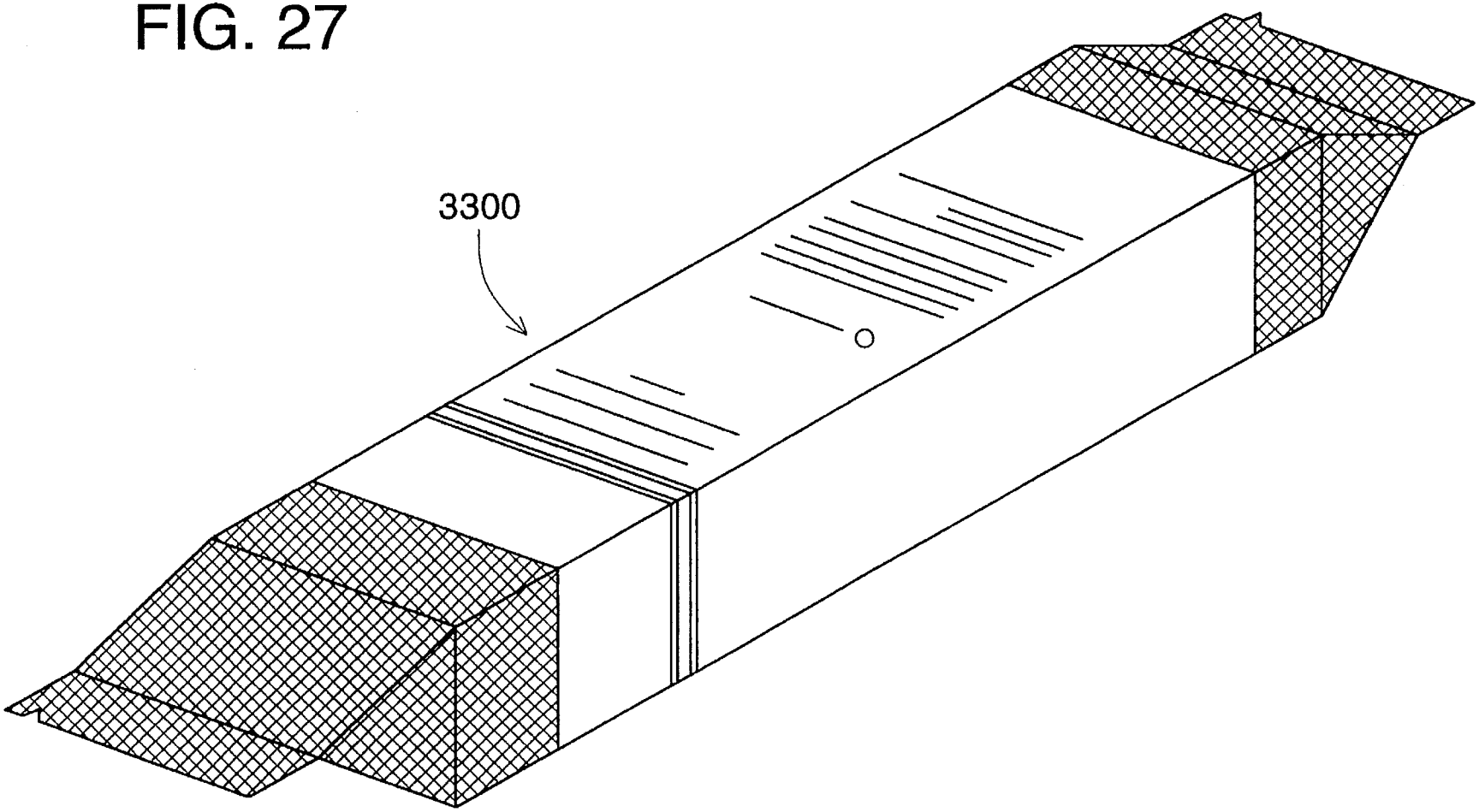
FIG. 27 is a perspective view of an example of the packaged accommodating container of the solid processing agent accommodating container of the present invention.

FIG. 27 is a perspective view showing an example of a packaged body 3300 of the accommodating container 33. The packaged body 3300 is a pillow packaged body made of a moisture-proof sheet formed into a cylindrical shape, wherein an aluminum foil and a plastic film (PE or nylon) are laminated to form the moisture-proof sheet. After the accommodating container 33 has been packaged by this laminated sheet, both ends are adhered by means of heat seal. Predetermined characters or signs are printed on the surface of the packaged body 3300. After the accommodating container has been packaged so as to be maintained in a moisture-proof condition, it is further packaged in an external box so that the accommodating container can be protected from an external force.

Figure 7:
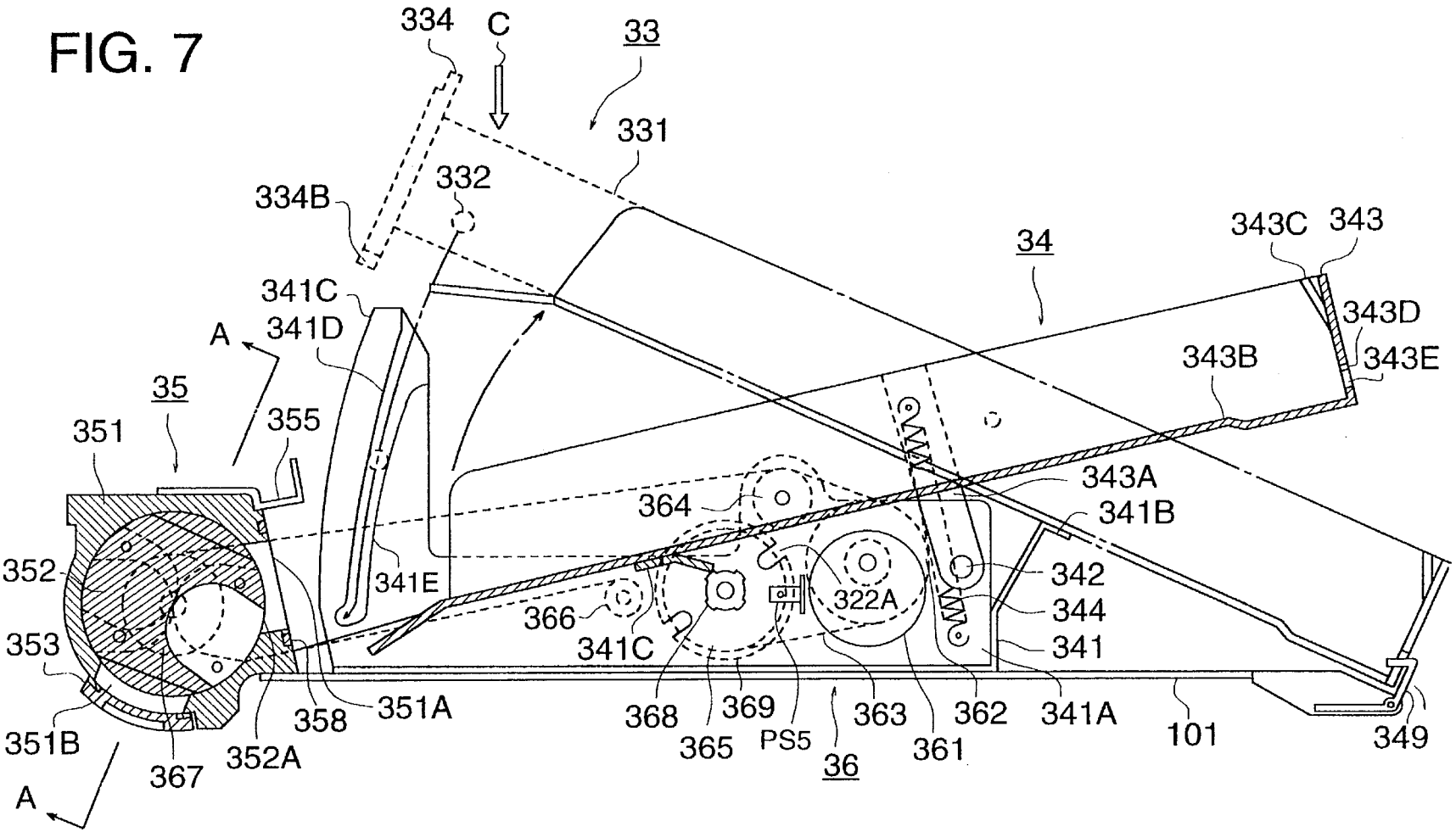
FIG. 7 is a sectional side view of the accommodating container charging means and supply means.

FIG. 7 is a sectional side view for explaining the operation of the accommodating container 33, accommodating container charging means 34, supply means 35 and drive means 36.

A fixed frame 341 of the accommodating container charging means 34, a housing member 351 and drive means 36 are fixed on an upper portion of the main body 101.

Support shafts 342 are protruded from both side plates 341A of the fixed frame 341 at the right end shown in the drawing. The support shafts 342 are engaged in holes disposed at a lower end of an arm 343A fixed on both sides of a container holding member 343 for holding the accommodating container 33, so that the container holding member 343 can be oscillated around the support shaft 342. The side plate 341A and arm 343A are respectively provided with a fixing pin, and a tension spring 344 is attached to the fixing pin. Therefore, as illustrated by a one-dotted chain line in the drawing, the container holding member 343 is rotated clockwise being pushed by the spring, and the bottom portion of the container holding member 343 comes into contact with a stopper portion 341B protruding to a right upper portion of the fixed frame 341. Then the movement of the container holding member 343 is stopped, and the container holding member 343 is maintained in a condition before the accommodating container 33 is mounted, that is, the container holding member 343 is maintained at the first position.

At a position close to the left end of the side plate 341A of the fixed frame 341, there is provided a rising portion 341C, in which a circular guide groove 341D is formed, wherein the circular guide groove 341D is provided around the support shaft 342. The accommodating container 33 is charged to the container holding member 343 of the accommodating container charging means 34, and the accommodating container holding member 343 is oscillated around the support shaft 342, so that the left end portion of the container holding member 343 is pushed downward in the direction C shown in the drawing. Then the guide pin 332 of the accommodating container 33 advances in the guide groove 341D while the guide pin 332 is being pushed downward by a pushing member 343C of the accommodating container charging means 34. An L-shaped groove portion 341E is formed in the lowermost portion of the guide groove 341D. When the pin 332B enters this L-shaped groove 341E being pushed by the pushing member 343C, the front of the accommodating container 33 closely comes into contact with an entrance portion 351A of the supply means 35 (the second position). When the accommodating container 33 is charged to the container holding member 343, a surface of the container holding member 343 comes into contact with a back surface 333A of the cap member 333 of the accommodating container 33. On the surface of the container holding member 343, there is provided a discrimination receiving section which engages with the discriminating section 333B disposed on the back surface 333A of the cap member 333. Consequently, according to the present invention, in the case where a wrong accommodating container is charged, the accommodating container 33 is not moved from the first position to the second position, wherein the first position is a position of the container holding member 343 before the accommodating container is charged, and the second position is the a position of the container holding member 343 at the time of supplying the processing agent. In other words, only when the discriminating section coincides with the discriminating receiving section, the accommodating container 33 is moved from the first to the second position. A means for preventing the accommodating container 33 from moving from the first to the second position is composed, for example, in such a manner that the accommodating container 33 is hooked by the upper cover 301 of the processing apparatus in the case where a wrong accommodating container is charged. Therefore, the wrong container can not be set in the processing tank. Alternatively, a means described later may be adopted.

The supply means 35 is disposed in the housing member 351 in such a manner that the supply means 35 can be rotated on an inner circumferential surface of the housing member 351. The supply means 35 includes a rotatable solid processing agent conveying member (rotor) 352, and a shutter section 353 for opening and closing the outlet portion 351B, wherein the solid processing agent conveying member (rotor) 352 has a pocket portion 352A by which a predetermined amount of solid processing agent J is received from the inlet portion 351A and moved to the outlet portion 351B.

A frame-shaped resilient packing 358 is embedded in the periphery of the opening on the end surface of the inlet portion 351A of the housing member 351. When the discharge opening of the accommodating container 33 is closely contacted with the inlet portion 351A, the atmosphere can be shut off by the frame-shaped resilient packing 358, so that moisture-proofing effect can be provided.

Figure 8:
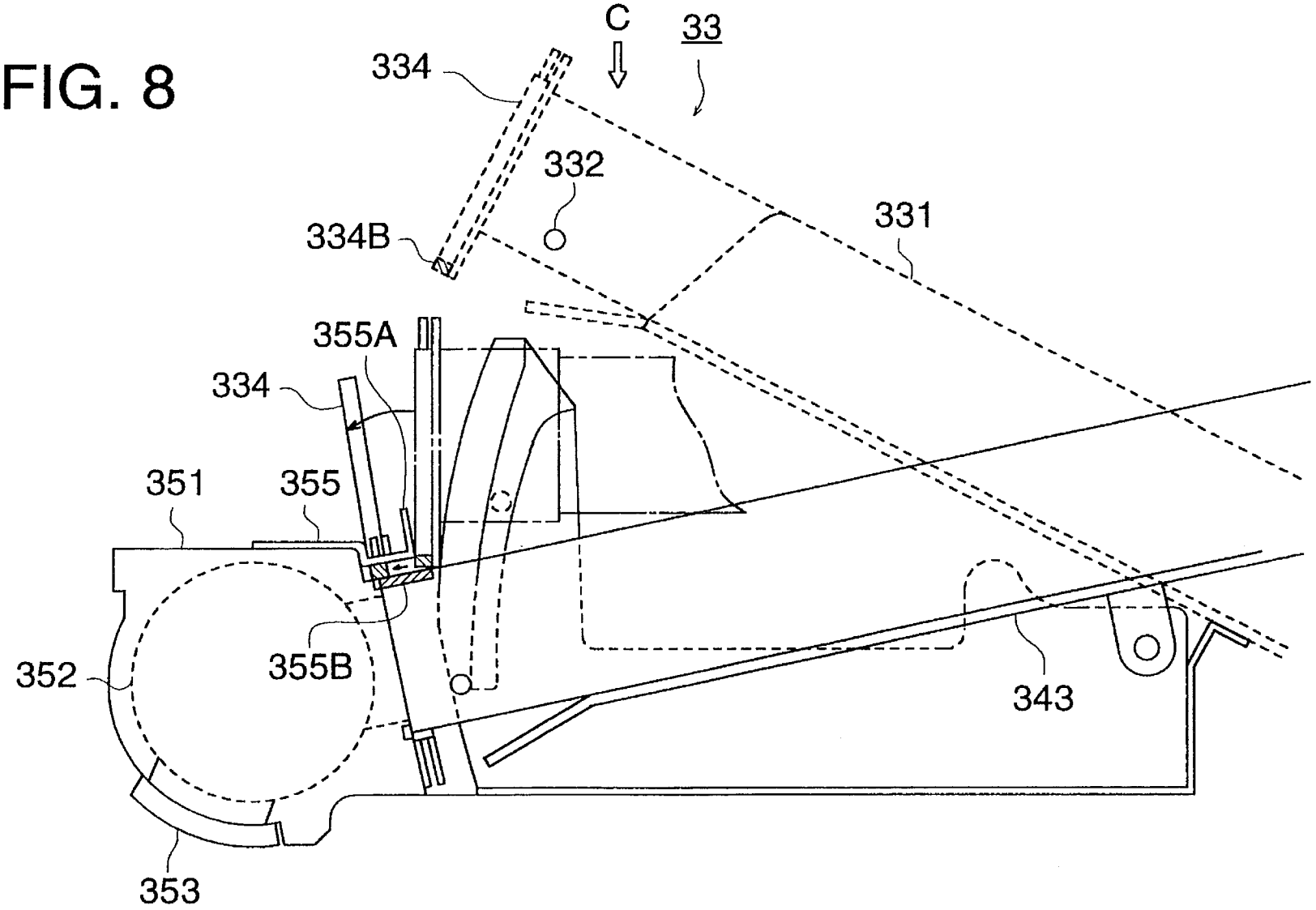
FIG. 8 is a side view for explaining the opening and closing operation of the sliding cover of the accommodating container.

FIG. 8 is a side view for explaining the opening and closing operation of the sliding cover 334 of the accommodating container 33.

At an upper position of the inlet portion of the housing member 351 of the supply means 35, there is provided an opening and closing regulating member 355 for regulating the opening and closing operation of the sliding cover. When the accommodating container 33 provided in the accommodating container charging means 34 is pushed downward from the initial position (shown by a one-dotted chain line) in the direction of arrow C in the drawing, the accommodating container 33 reaches the intermediate position (shown by a one-dotted chain line). Then the descending motion of a protrusion 334B of the sliding cover 334 is stopped by the opening and closing regulating member 355(355B). When the accommodating container 33 is further oscillated, the opening of the outlet opening member 332 of the accommodating container 33 is gradually opened since the sliding cover 334 can not further go downward. When the downward motion of the accommodating container 33 is stopped at a predetermined position, the opening is completely opened, and the solid processing agent tablet J in the first row in the accommodating container 33 is sent to the supply means 35. This complete opening condition is shown by a solid line in the drawing.

When all solid processing agent tablets J in the accommodating container 33 have been successively consumed, a remainder detection signal is generated, and an operation to replace the accommodating container 33 with another one is conducted in accordance with the signal. When the accommodating container 33 is withdrawn backward, the accommodating container 33 and container holding member 343 are rotated clockwise, so that the left end portion is raised. In this ascending process, the opening and closing regulating member 355A stops the motion of the sliding cover 334, and only the main body composed of the container main body 331 and the cap member 333 is raised, so that the opening portion is closed by the sliding cover 334. Further, in the latter half process in which the accommodating container 33 is raised, the apparatus is returned to the initial condition, which is an upper dead point, while the opening portion is in a closed condition. Therefore, powder of the processing agent in the container can be prevented from being scattered. Even when the container is removed for maintenance while the processing agent remains in the container, the processing agent can not be dispersed since the opening portion is in a closed condition.

Figure 9:
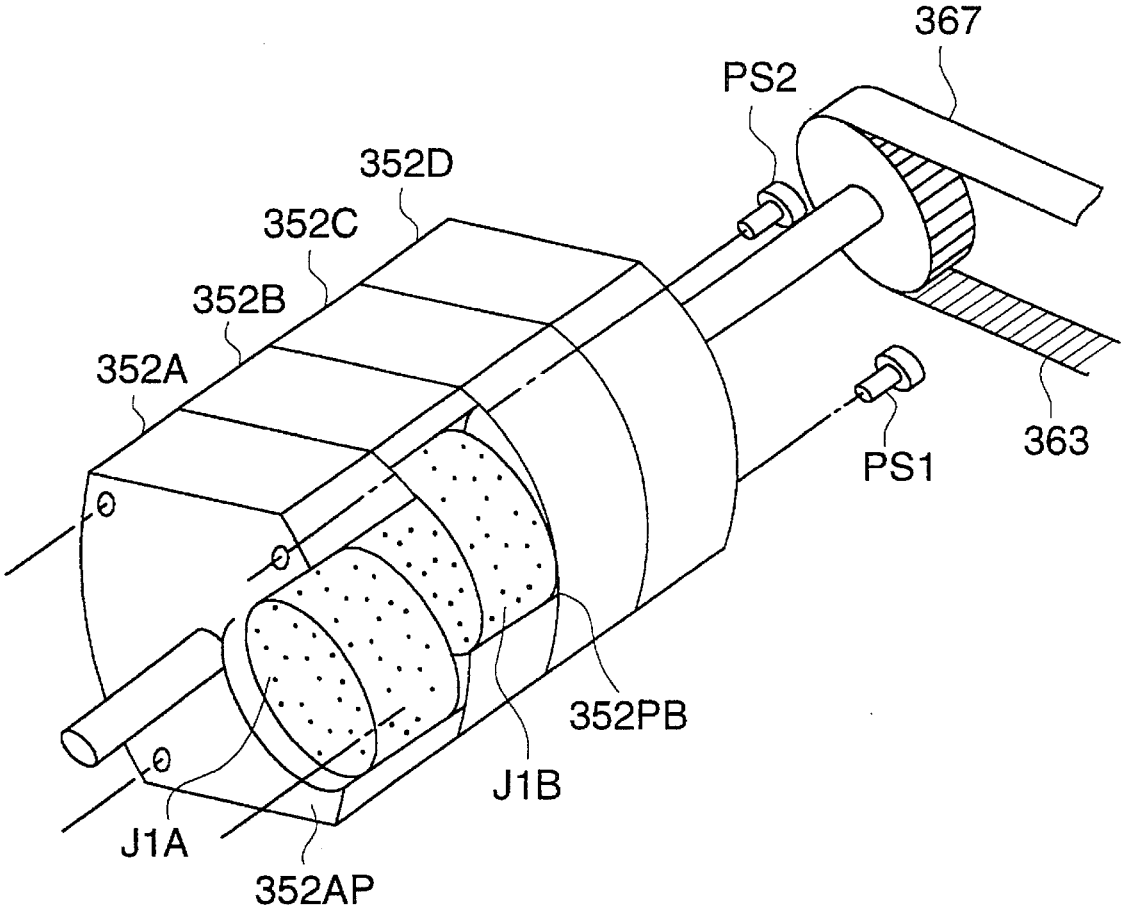
FIG. 9 is a perspective view of the processing agent receiving member (rotor) of the supply means.

FIG. 9 is a perspective View of the processing agent conveyance member (rotor) provided in the supply means 35. The rotor 352 is compose of 4 rotors 352A, 352B, 352C, 352D which are integrally mounted on the same shaft. Each rotor is provided with one pocket (352AP, 352BP, 352CP, 352DP). Each pocket can accommodate one solid processing agent (J1A, JIB, J1C, J1D). The phase of each pocket is shifted. Therefore, when the rotor 352 is rotated by one revolution, the solid processing agent J1A is charged into the first pocket 352A from the discharge opening of the accommodating container 33. Then the solid processing agent tablets are successively charged into the second, third and fourth pockets (352AP, 352BP, . . . ). In the same manner, the solid processing agent tablets are successively discharged outside from the outlet portion 351B.

In each rotor (352A, 352B, 352C, 352D), 4 through-holes are formed. Optical passages of the transmission type optical sensors PS1, PS2 composed of a light emitting element and light receiving element pass through these through-holes. Since the phase of each pocket is shifted, it can be detected whether or not the solid processing agent J is accommodated in each pocket.

Figure 10:
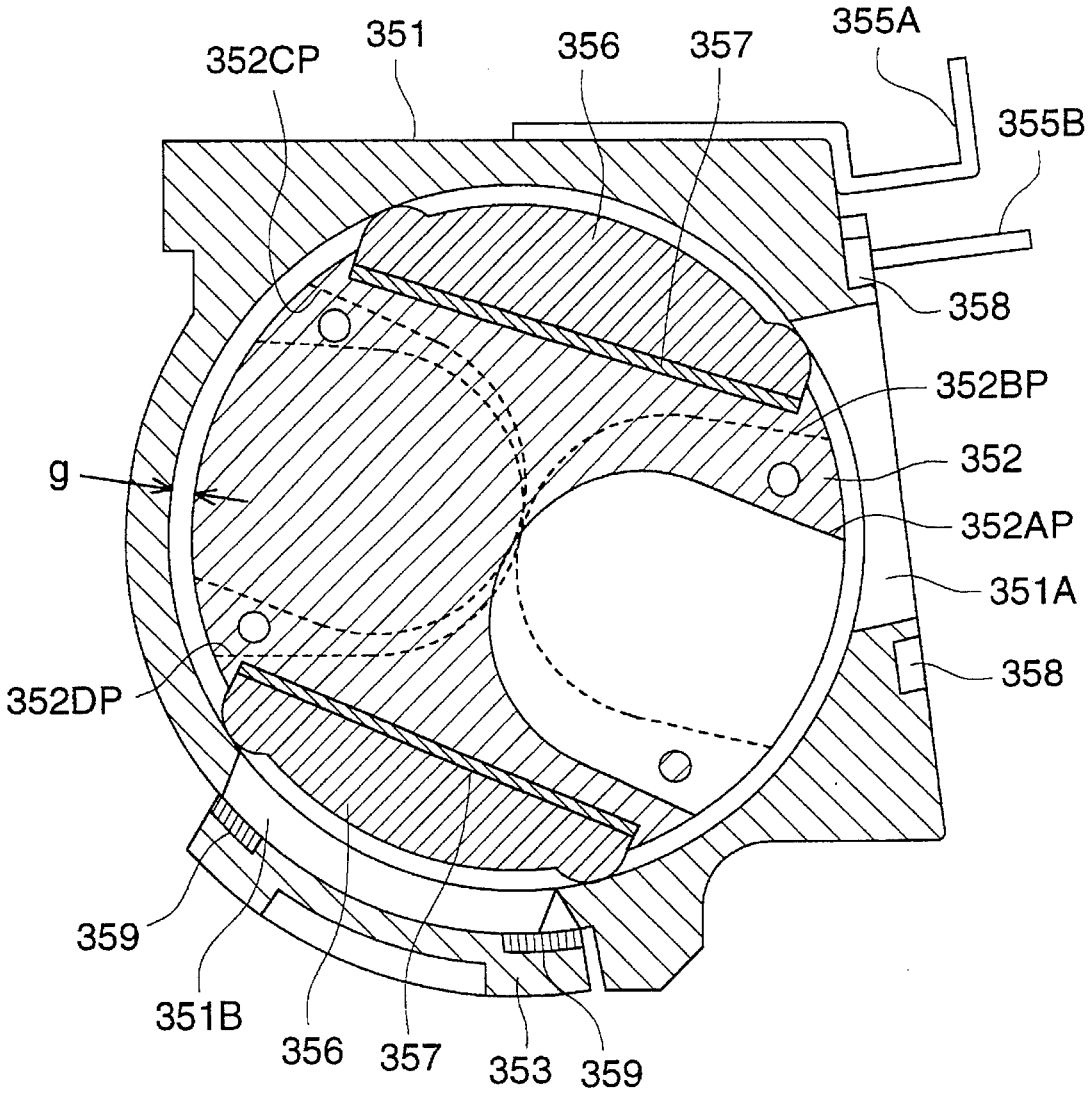
FIGS. 10(A) and 10(B) are enlarged sectional views of the supply means.
Figure 10:
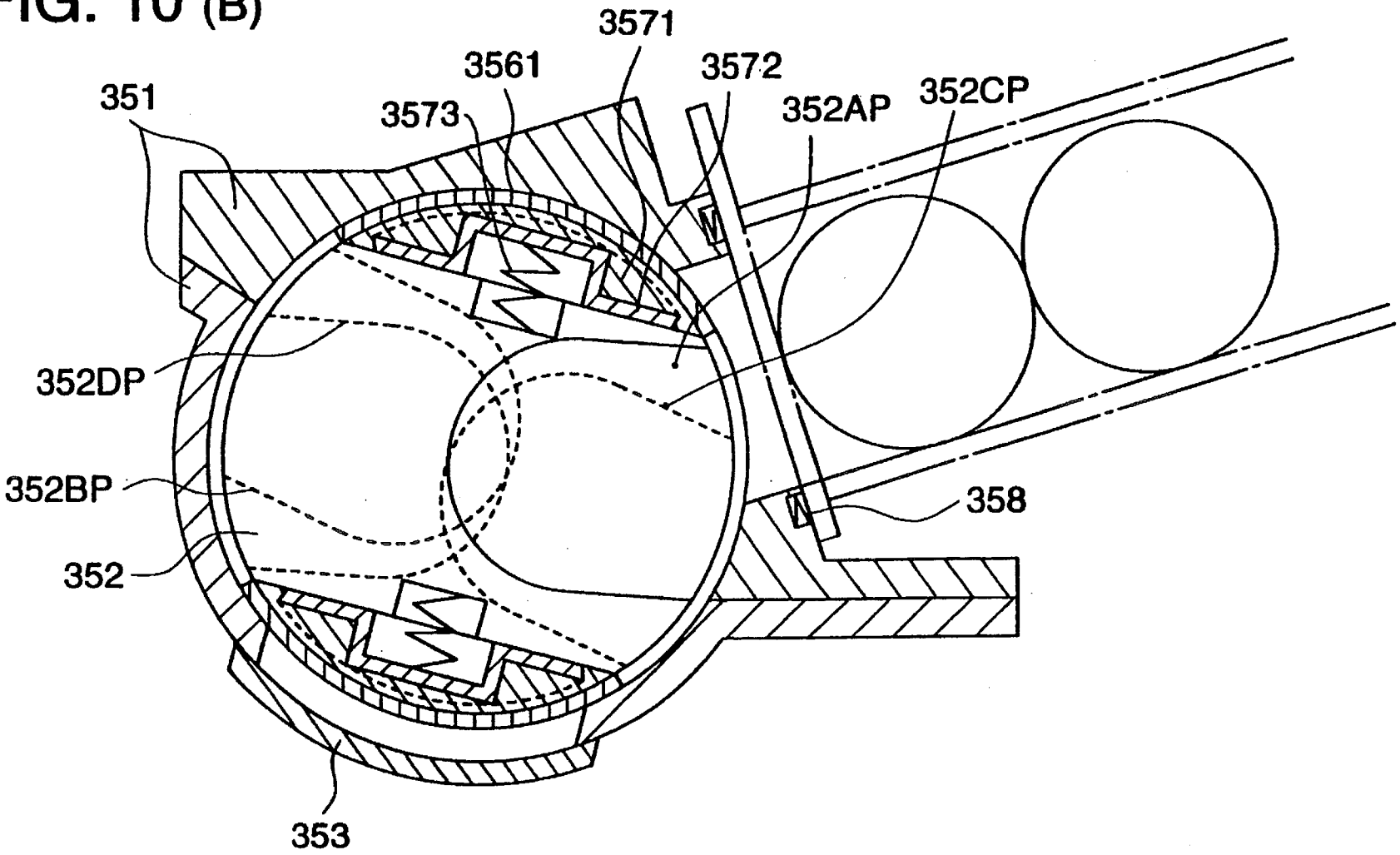

FIG. 10(A) is an enlarged sectional view of the supply means 35. The outer diameter of the rotor 352 is a little smaller than the inner diameter of the housing member 351, so that a small gap "g" is formed. The reason why the gap "g" is formed is described as follows. When the outer and inner diameters are formed to be the same dimension, the solid processing agent J enters and clogs the gap. As a result, the rotor 352 may not be rotated. In order prevent the occurrence of the above problem, the small gap "g" is provided.

Two sliding members 356 are attached to the outer circumference of the rotor 352 through a resilient member 357. When the sliding member 356 comes into surface-contact with the inner circumferential surface of the housing member 351, a sealed condition can be maintained between the housing member 351 and the rotor 352.

In order to maintain the sealing condition (the moisture-proof condition) between the housing member 351 and the rotor 352, the following embodiment is preferably adopted: As shown in FIG. 10(B), two processing agent receiving moisture-proof members are provided at two positions on the outer circumference of the rotor 352. This processing agent receiving moisture-proof member has a compound structure. That is, the processing agent receiving moisture-proof member comprises a resilient member 3571 by which the sliding member 1561B having a low friction coefficient can be closely contacted, and a support member 3572. While the processing agent receiving moisture-proof member is being pushed to the inner wall of the casing by the push spring 3573 so that the processing agent receiving moisture-proof member is closely contacted with a low pressure, it can be rotated with a low torque. When the periphery of the sliding member 3561 is contacted with the inside diameter portion of the housing member 351, the housing member 351 and the rotor 352 are maintained in a moisture-proof condition.

The resilient packing 358 is embedded in the periphery of the opening on the end surface of the inlet portion 351A of the housing member 351. The packing 358 is closely contacted with the discharge opening of the outlet member 332 of the accommodating container 33. Therefore, moisture-proofing effect with respect to the atmosphere (vapor of the processing solution in the processing tank) can be provided.

On the other hand, the outlet portion 351B of the housing member 351 can be opened and closed by the shutter member 353. A resilient packing 359 is stuck on the inner surface of the shutter member 353, so that moisture-proofing effect can be provided to the outlet portion 351B.

The shutter member 353 is linked with the rotation of the rotor 352 and reciprocated along a portion of the outer circumference of the housing member 351. When the rotor 352 starts rotating, the outlet portion 351B is opened. When the rotor 352 is rotated by a half revolution, two solid processing agent tablets J are put into the processing tank 1, and then the outlet portion 351B is closed.

FIGS. 11(A) to 11(C) and FIGS. 12(A) to 12(C) are sectional views showing the process of dropping the solid processing agent tablets J by the supply means 35. FIG. 11(A) shows a standby condition in the initial stage. Under this condition, the inlet portion 351A and the outlet portion 351B of the housing member 351 are shielded by the processing agent receiving member 352 and the sliding member 356, so that the atmosphere is prevented from entering. FIG. 11(B) shows a condition in which the rotor 353 is normally rotated and one solid processing agent tablet J1A at the fore end of the row A in the accommodating container 33 is accommodated in the pocket 352AP in the row A of the rotor 352. FIG. 11(C) shows a condition in which the rotor 353 is further rotated normally and the solid processing agent tablet J1B is accommodated in the second pocket 352BP.

FIG. 12(A) shows a condition continued to the condition in FIG. 11(C). In the condition in FIG. 12(A), the rotor 352 is further rotated normally and the pocket 352AP coincides with the outlet portion 351B of the housing member 351, and the first solid processing agent tablet J1A included in the pocket 352AP is dropped. FIG. 12(B) shows a condition in which the rotor 352 is successively rotated in the normal direction and the second solid processing agent tablet J1B is dropped, that is, 2 solid processing agent tablets are dropped. After that, the rotor 352 is reversed, so that it is returned to the initial position and stopped (shown in FIG. 12(C)). In this stopping condition, there is no solid processing agent tablet J in the rotor 352, that is, this stopping condition is a waiting condition. When the shutter member 353 is rotated counterclockwise at the same time, the outlet portion 351B is closed by the shutter member 353, and when 2 solid processing agent tablets J have been dropped, one cycle of operation is completed. In the next cycle of operation, the solid processing agent tablets J1C, J1D are successively charged and dropped with respect to the third pocket 352CP in the row C and the fourth pocket 352DP in the row D. After that, the opening portion 351B is closed by the shutter member 353 again. In this way, when the rotor 352 is rotated by a half revolution, 2 solid processing agent tablets are successively dropped. After dropping, the outlet portion 351B is closed by the shutter member 353 which has been returned.

Referring to FIG. 7, the drive means of the solid processing agent replenishing device of the present invention will be explained as follows.

The drive means 36 of the present invention is disposed under the accommodating container charging means 34. A timing belt 363 is wound around a timing pulley 362 mounted on the drive shaft of the motor 361. The timing belt 363 rotates a pulley 367 mounted on the rotational shaft of the rotor 352, through pulleys 364, 365 and a tension pulley 366.

A cam 368 is mounted on the same shaft as that of the pulley 365. On the other hand, a claw portion 341C is fixed onto the bottom surface of the container holding member 343 and engaged with the cam 368.

When the pulley 365 and cam 368 are rotated by the drive of the motor 361, a protruding portion of the cam 368 pushes up the claw portion 341C, and a cutout portion of the cam 368 is separated from the claw portion 341C. When the cam 368 is rotated, shocks are repeatedly given to the claw portion 341C and the container holding member 343 formed integrally with the claw portion 341C. Due to the foregoing, the solid processing agent tablet J in the accommodating container 33 rolls to the discharge port along an inclined surface of the package body 331. The rolling motion of the solid processing agent tablet J is not stopped halfway.

A cutout disk 369 having 2 cutout portions is integrally mounted on the same shaft as that of the pulley 365. When the photo-interrupter type optical sensor PS5 detects the passage of the cutout portion, a positional detection signal is emitted, and one cycle stopping operation of the rotor 352 is controlled.

As explained above, 4 solid processing agent tablets J are successively dropped. Accordingly, when a chute 27 through which only one solid processing agent tablet J can pass is provided under the supply means 35 as shown in FIG. 3, the tablet J can be easily dropped even in a small space above the constant temperature tank 2, and further the filter 28 can be easily replaced. The reason why the phase of the solid processing agent J1A and that of the solid processing agent J1B are shifted is described as follows.

(1) It is an object to prevent two solid processing agent tablets J from being engaged with each other in the chute 27. In this way, the two solid processing agent tablets J can be prevented from being caught by the chute 27.

(2) It is an object to independently detect the solid processing agent tablets J with the sensors PS1, PS2 in order to check the necessity of replenishment of the solid processing agent tablets J. In this connection, the number of the solid processing agent tablets J to be dropped in one cycle is not limited to 2, but 4 solid processing agent tablets J may be dropped while the rotor is rotated by one revolution.

In the above embodiment, the accommodating container is held in an inclined disposition, so that each processing agent tablet rolls or slides toward the discharge opening by the action of gravity. According to the present invention, the accommodating container is necessarily held in an inclined disposition. The most important point of the present invention is that the solid processing agent tablets are accommodated in the container in such a manner that the outer circumference of each circular solid processing agent tablet is externally contacted with each other. The second important point of the present invention is that a supply means provided close to the accommodating container is used when the processing agent tablets are supplied from the accommodating container to the processing tank, wherein the supply means includes a processing agent receiving member for moving the processing agent tablets from the inlet to the outlet.

As long as the aforementioned important points are secured, any configurations of the accommodating container and supply means can be adopted, and any methods of conveying the processing agent tablets and any method of installation can be adopted. For example, the accommodating container shown in FIG. 5 may be maintained to be horizontal, and a resilient member is provided on the side of the cap member 333, so that the processing agent tablets can be moved toward the discharge opening, or alternatively the processing agent tablets can be discharged from the discharge opening. Alternatively, the accommodating container may be held vertical, and the processing agent tablets are moved toward the discharge opening by the action of gravity or by the assistance of another member.

In the example, the discharge opening is disposed in such a manner that the discharge opening is opposed to the cap member 333. However, it should be noted that the present invention is not limited to the specific example. For example, in the accommodating container shown in FIG. 5(B), the discharge opening may be provided under the processing agent tablet J1A, and the supply means may be closely contacted with this discharge opening so that the processing agent tablets can be dropped. Alternatively, in FIG. 5(A), the partition walls of J1A, J1B, J1C and J1D may be removed, and a discharge opening may be formed on the J1A and/or J1D side, and the supply means may be closely contacted with the discharge opening. In this case, the guide pin 332 is not disposed at a position indicated in the drawing, but it may be disposed at a shifted position. When consideration is given to the fact that moisture enters from the discharge opening, in the embodiment in which the discharge opening is provided on the side of the J1A and/or J1D, it is preferable from the viewpoint of moisture-proofing that the number of rows is reduced, for example, the number of rows is made to be 2, and the partition walls are not removed. In any cases, the movement of processing agent tablets toward the discharge opening and the discharge of processing agent tablets from the discharge opening may be made by the action of gravity or the assistance of another member. When gravity is used for moving and discharging the processing agent tablets, the mechanism can be simplified and the number of parts can be reduced so that moisture-proofing can be easily made. Accordingly, using gravity is advantageous.

According to the supply means of the present invention, the operation for adding the processing agent from the accommodating container to the processing tank can be controlled, and further the supply means is interposed between the accommodating container and the processing tank so that the moisture-proofing effect of unused processing agent can be enhanced. Since the inlet and outlet of the processing agent are separated by the receiving member, moisture-proofing can be effectively made. Accordingly, the aforementioned example is one of the preferred embodiments. However, it should be noted that the supply means is not limited to the specific embodiment. As long as the moisture-proofing effect of unused processing agent can be enhanced while the supply means is interposed between the accommodating container and the processing tank, any means may be adopted.

Figure 11:
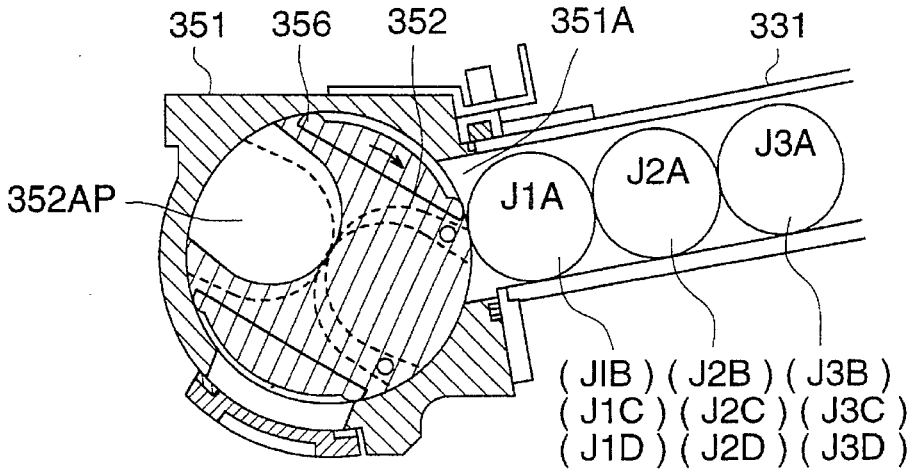
FIGS. 11(A) to 11(C) are sectional views showing the solid processing agent charging process conducted by the supply means.
Figure 11:
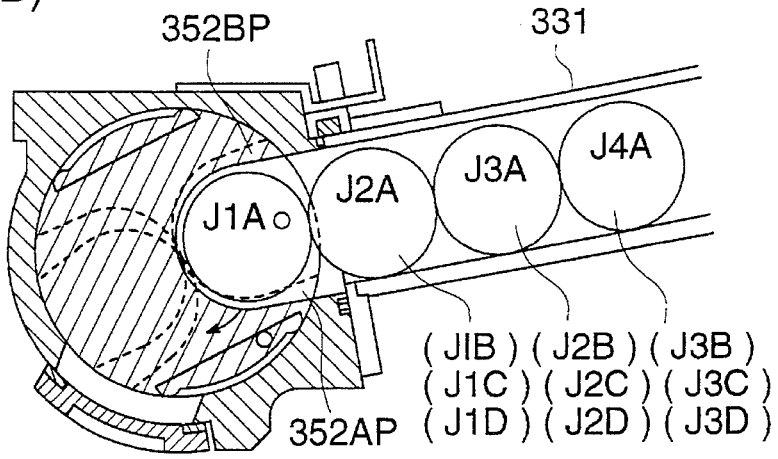
Figure 11:
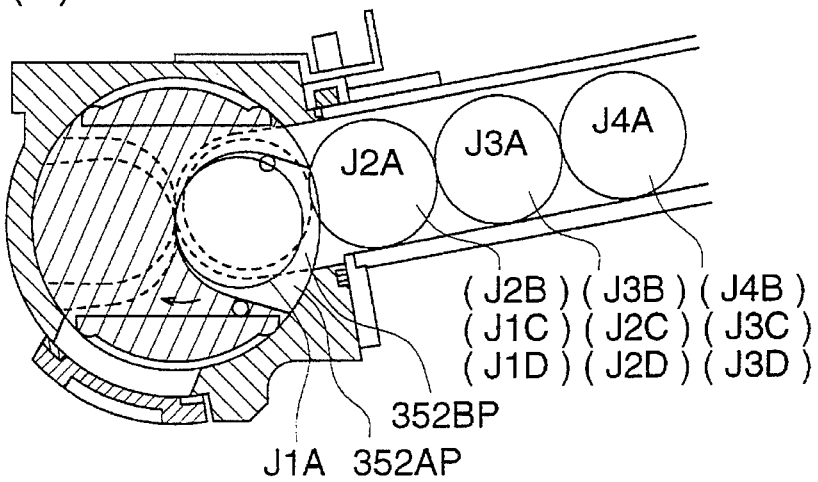
Figure 12:
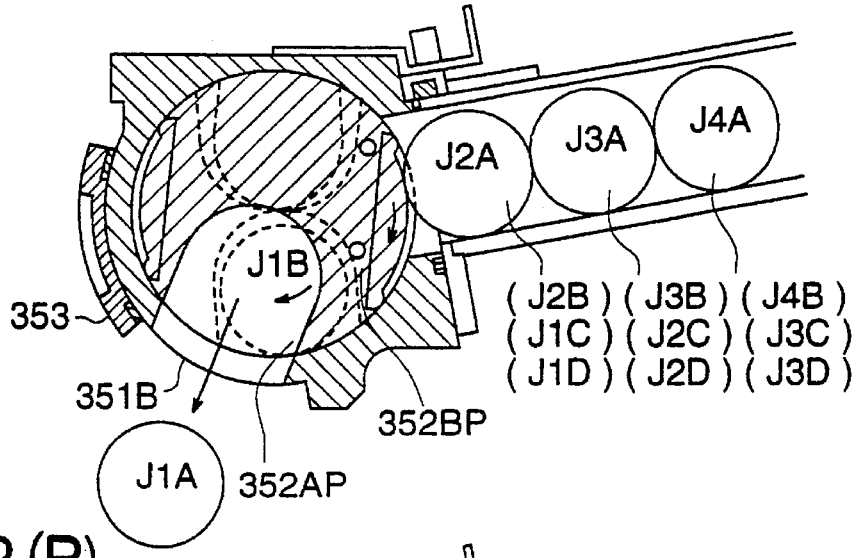
FIGS. 12(A) to 12(F) are sectional views showing the solid processing agent charging process conducted by the supply means.
Figure 12:
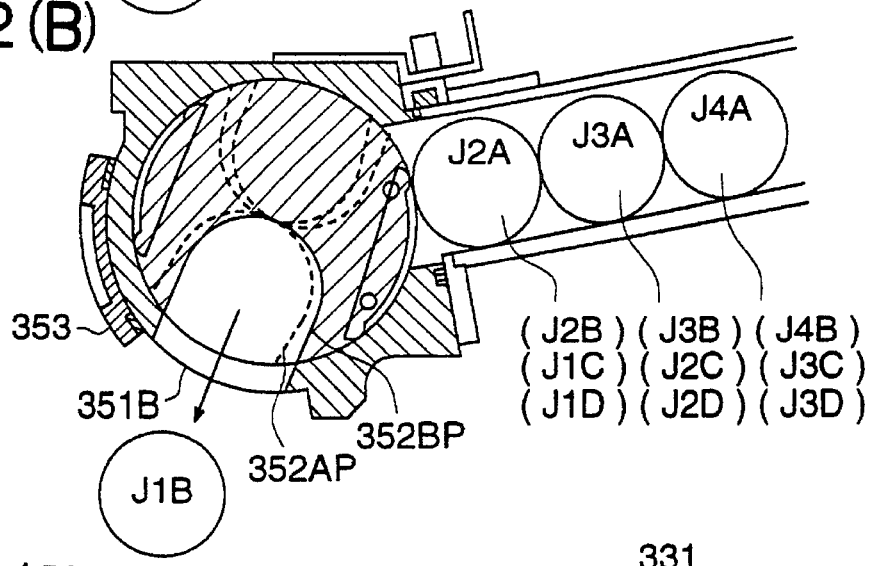
Figure 12:
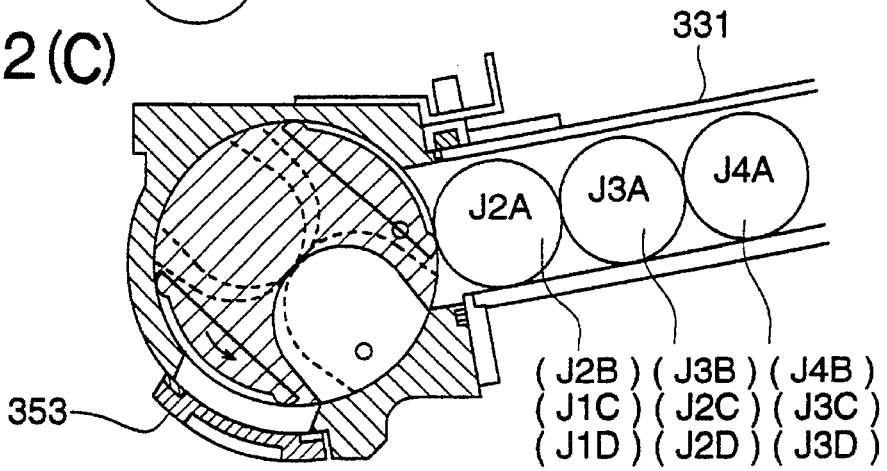
Figure 12:
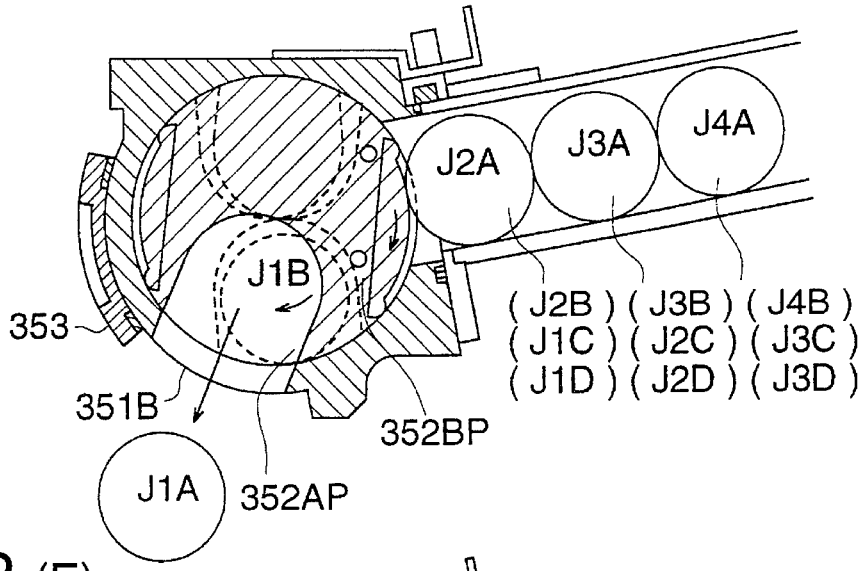
Figure 12:
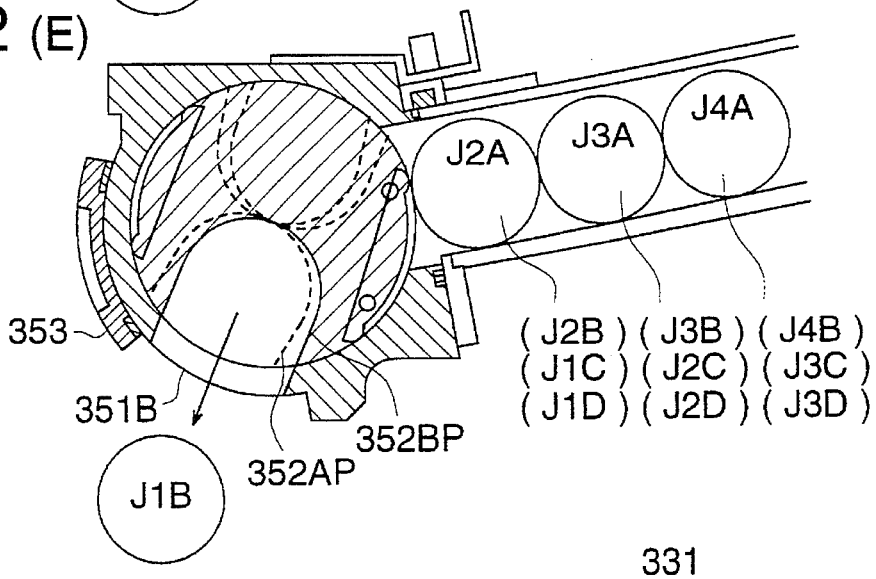
Figure 12:
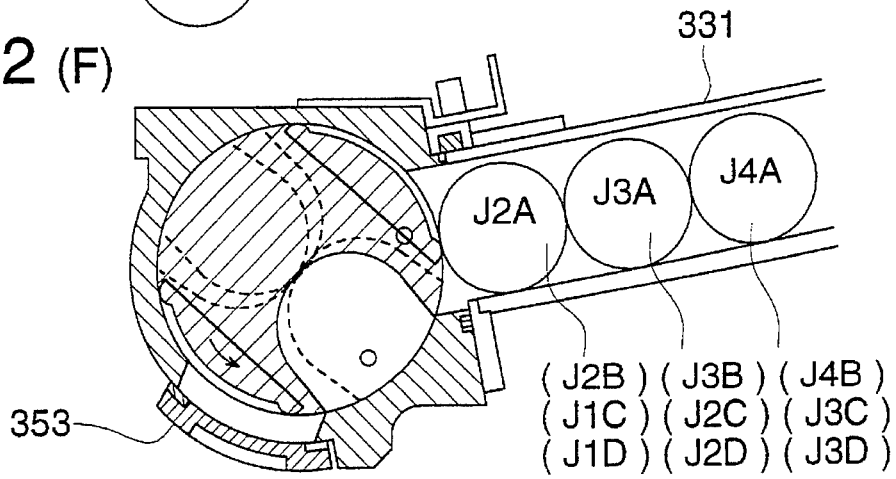

For example, in the apparatus shown in FIGS. 11 and 12, the inlet and outlet are disposed on the same surface, however, they may be disposed on different surfaces, for example, the outlet may be disposed on a surface perpendicular to the surface on which the inlet is disposed. In the example of the present invention, the processing agent moves on the same surface when it is conveyed from the accommodating container to the processing tank through the supply means. However, it is not necessary that the processing agent is conveyed on the same surface when it is sent to the processing tank. The processing agent may be conveyed from the discharge opening in a direction in which the direction of the inlet crosses, and then the processing agent is supplied to the processing tank. That is, a supply means may be adopted, in which the oscillating shaft is provided in the longitudinal direction of the accommodating container. In this case, the number of rows is not necessarily 4. The number of rows may be 1 or 2. In the case where an embodiment shown in FIG. 5(A) is adopted in which the discharge opening is provided on the side of J1A and/or J1D, the oscillating shaft may be provided in the lateral direction of the accommodating container.

In the explanations made above, when the processing agent tablets are moved from the inlet to the outlet, rotational motions are utilized. However, as long as the moisture-proofing effect can be provided, the processing agent tablets are not necessarily moved by the rotational motion.

Figure 13:
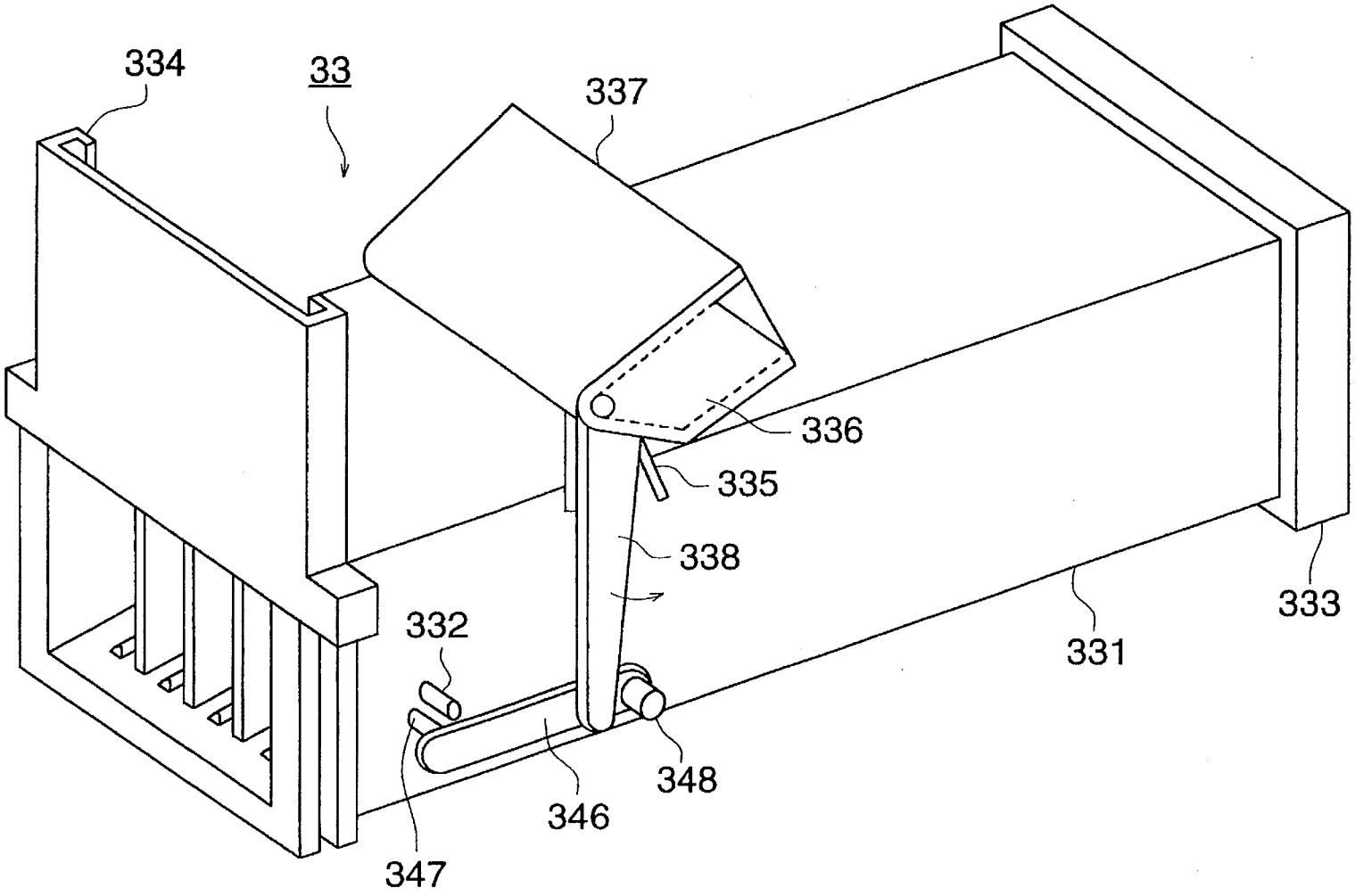
FIG. 13 is a perspective view showing another example of the accommodating container charging means according to the present invention.
Figure 14:
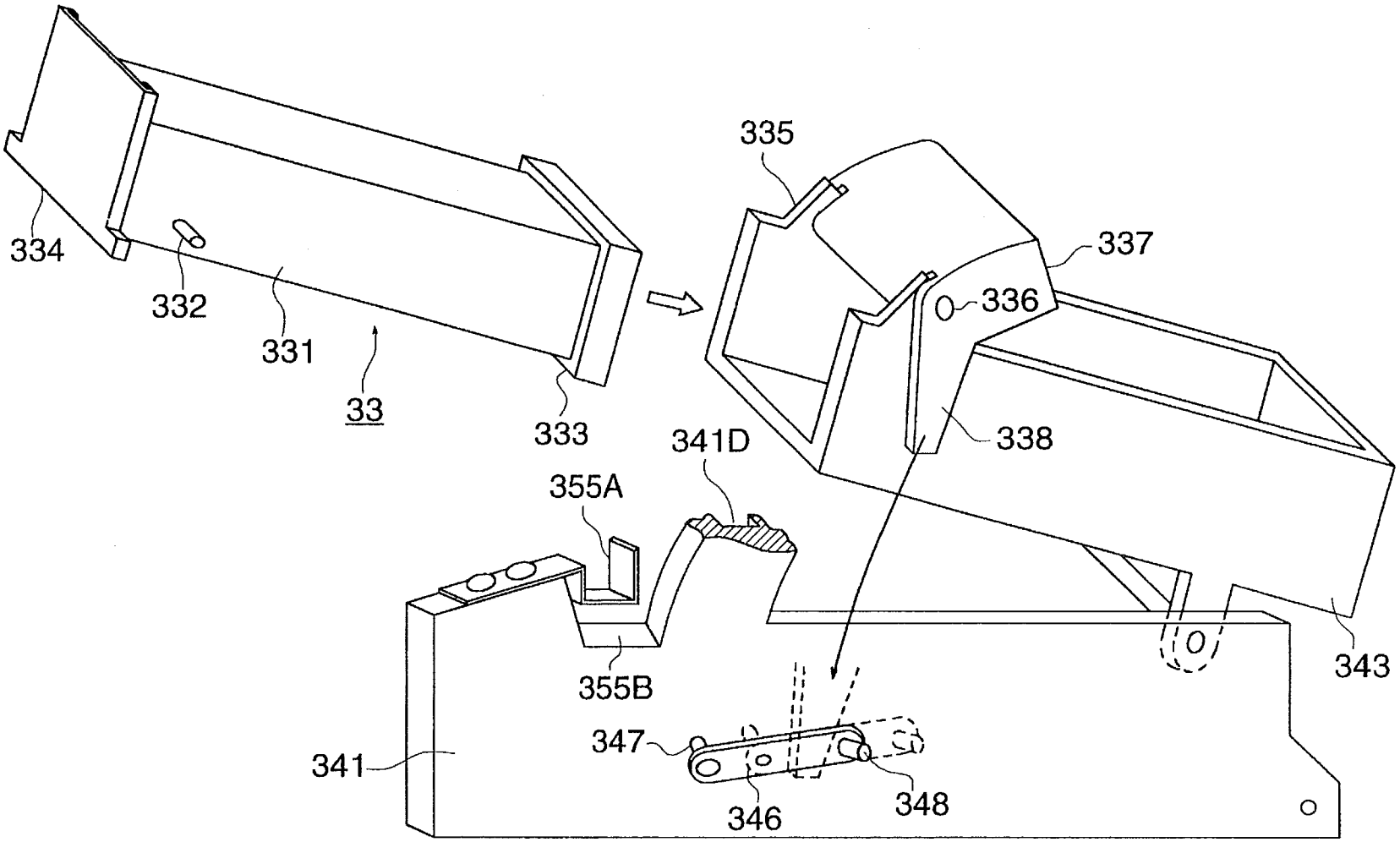
FIG. 14 is a perspective view of the accommodating container charging means.
Figure 15:
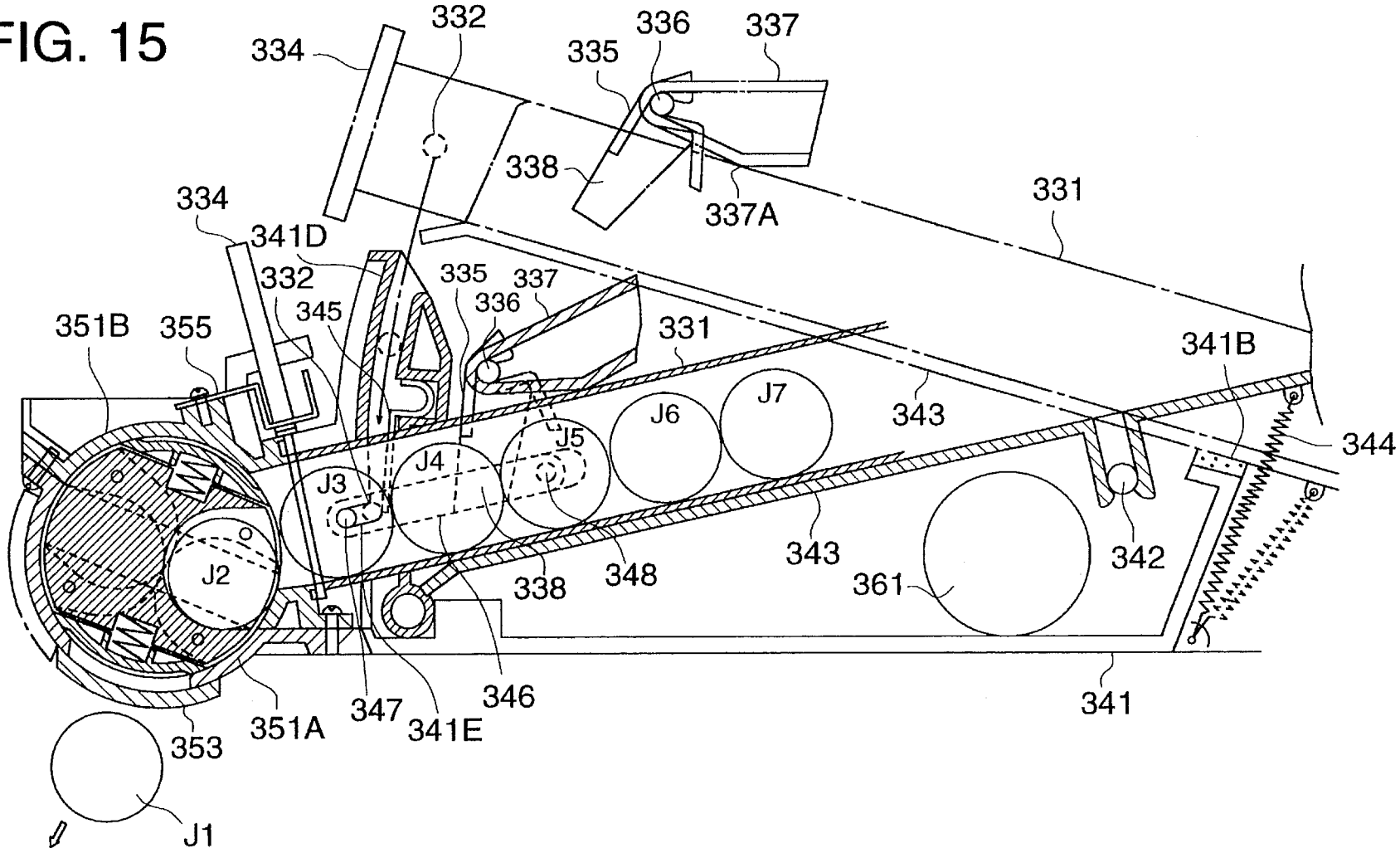
FIG. 15 is a sectional view showing a condition in which the accommodating container is attached to the accommodating container charging means.

FIGS. 13 and 14 are perspective views showing another embodiment of the solid processing agent accommodating container 33 of the present invention. FIG. 15 is a sectional view showing the circumstances in which the accommodating container 33 is attached to the accommodating container charging means 34. In this connection, like parts in each of the figures are identified by the same reference character. Only different points from the aforementioned embodiment will be explained as follows.

A pair of shaft supporting members 335 are integrally fixed onto both sides on the upper surface of a container holding member 343. A shaft 336 mounted on the shaft support member 335 rotatably supports a handle member 337. A section of the handle member 337 is approximately formed into a U-shape. Therefore, when an operator puts his finger into the recessed portion, the handle member 337 can be easily rotated. When the accommodating container 33 is set at a predetermined position on the container holding member 343 of the accommodating container charging means 34 and the upper surface of the handle member 337 is pushed downward, a lower end 337A of the handle member 337 pushes an upper surface of the container main body 331, so that the accommodating container 33 and the container holding member 343 are oscillated downward around a support shaft 342 and reaches a lower dead point. Then the accommodating container 33 and the container holding member 343 are locked by a lock means described later. In the process of downward motion, the guide pin 332B implanted onto the side of the accommodating container 33 is lowered along a guide groove 341D formed on the fixed frame 341 of the accommodating container charging means 34. When the guide pin 332B reaches a position close to the lower dead point, the guide pin 332B is pushed into an L-shaped groove 341E being pushed by the resilience of a leaf spring 345, and the accommodating container 33 is moved to the left in the drawing and held in an engaging condition.

At one end of the handle member 337, a lever 338 is integrally protruded downward. On both side walls of the solid frame body 341, sliding plates 346 are supported in such a manner that they can be linearly moved. A first pin 347 is implanted at a position close to the left end of the sliding plate 346 in the drawing. When the guide pin 332 is engaged with the L-shaped groove 341E, the first pin 347 is pushed by the guide pin 332 and moved to the left in the drawing. Therefore, the sliding plate 346 is stopped at the left end.

A second pin 348 is implanted at a position close to the right end of the sliding plate 346. In the case where the accommodating container 33 is replaced after all the solid processing agent tablets have been used up, or in the case of maintenance, the operator holds the handle member 337 and rotates the shaft 336 counterclockwise. Due to the foregoing operation, the lever 338 is also rotated counterclockwise, and the fore end of the lever 338 pushes the second pin 348, so that the second pin 348 is moved to the right in the drawing. Due to the foregoing, the sliding plate 346 is also moved to the right, and the first pin 347 moves the guide pin 332 to the right, resisting the force of the leaf spring 345. Therefore, the lock is released at a lower end of the arcuate guide groove 341D. After the lock has been released, the accommodating container 33 and the container holding member 343 are moved upward along the guide groove 341D by the force of the tension spring 344. Therefore, the accommodating container 33 and the container holding member 343 are returned to the initial positions as shown by one-dotted chain lines in FIG. 15. Under this condition, the accommodating container 33 can be detached.

Figure 16:
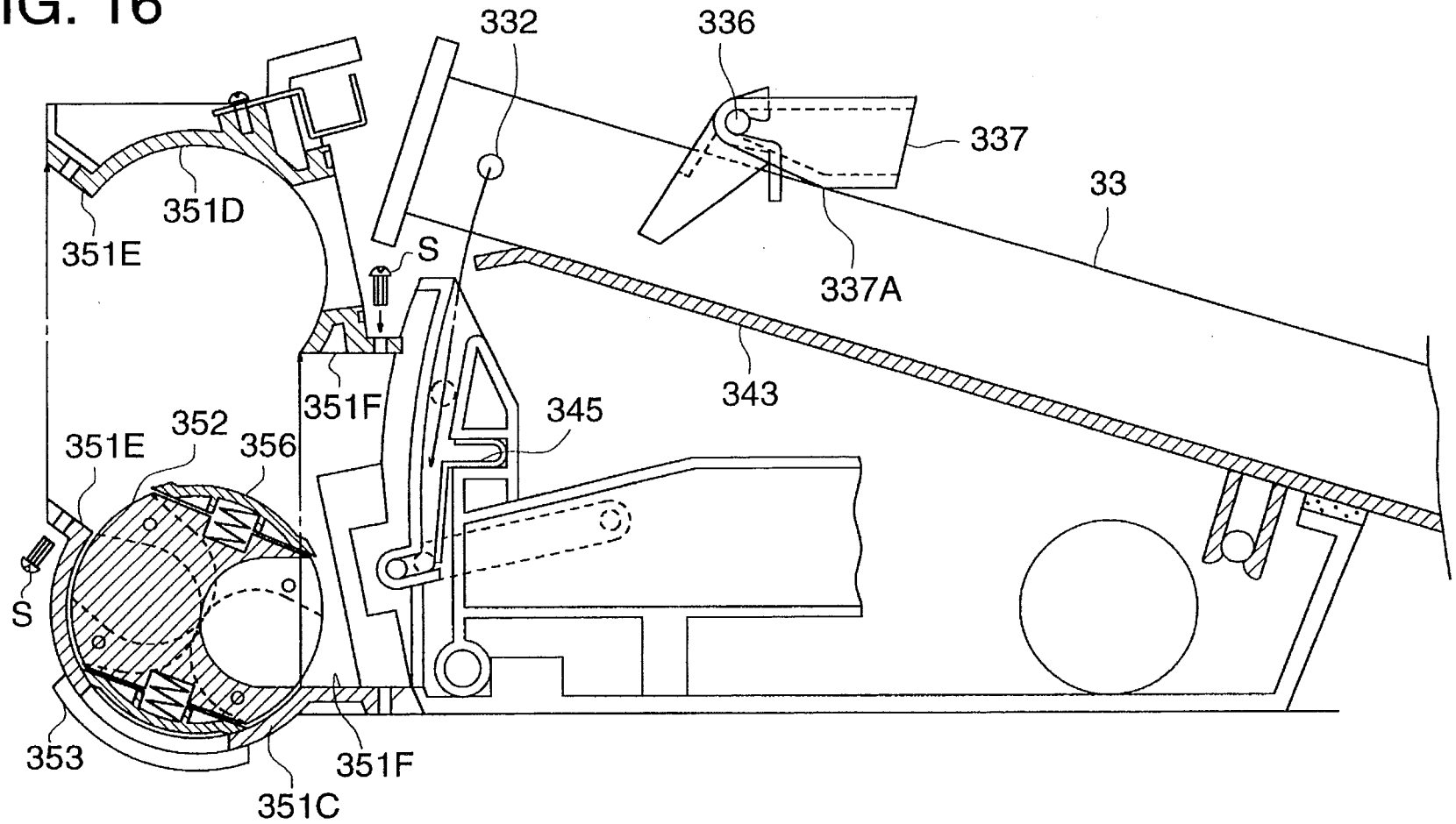
FIG. 16 is an exploded sectional view of the solid processing agent replenishing device.

FIG. 16 is an exploded sectional view of the solid processing agent replenishment device. The housing member 351 is composed of a lower fixed frame body 351C, and an upper cover member 351D capable of being opened and closed with respect to the fixed frame body 351C, that is, the housing member 351 can be divided into 2 pieces, one is the lower fixed frame body 351C and the other is the upper cover member 351D. As illustrated in the drawing, dividing surfaces 351E and 351F are formed. These dividing surfaces 351E and 351F are fastened by fastening screws S, so that they are closely contacted and integrated into one body. When the fastening screws S are removed and the upper cover member 351D are opened, the rotor 352 and sliding member 356 provided inside are exposed, so that the inspection and maintenance can be easily carried out.

Figure 17:
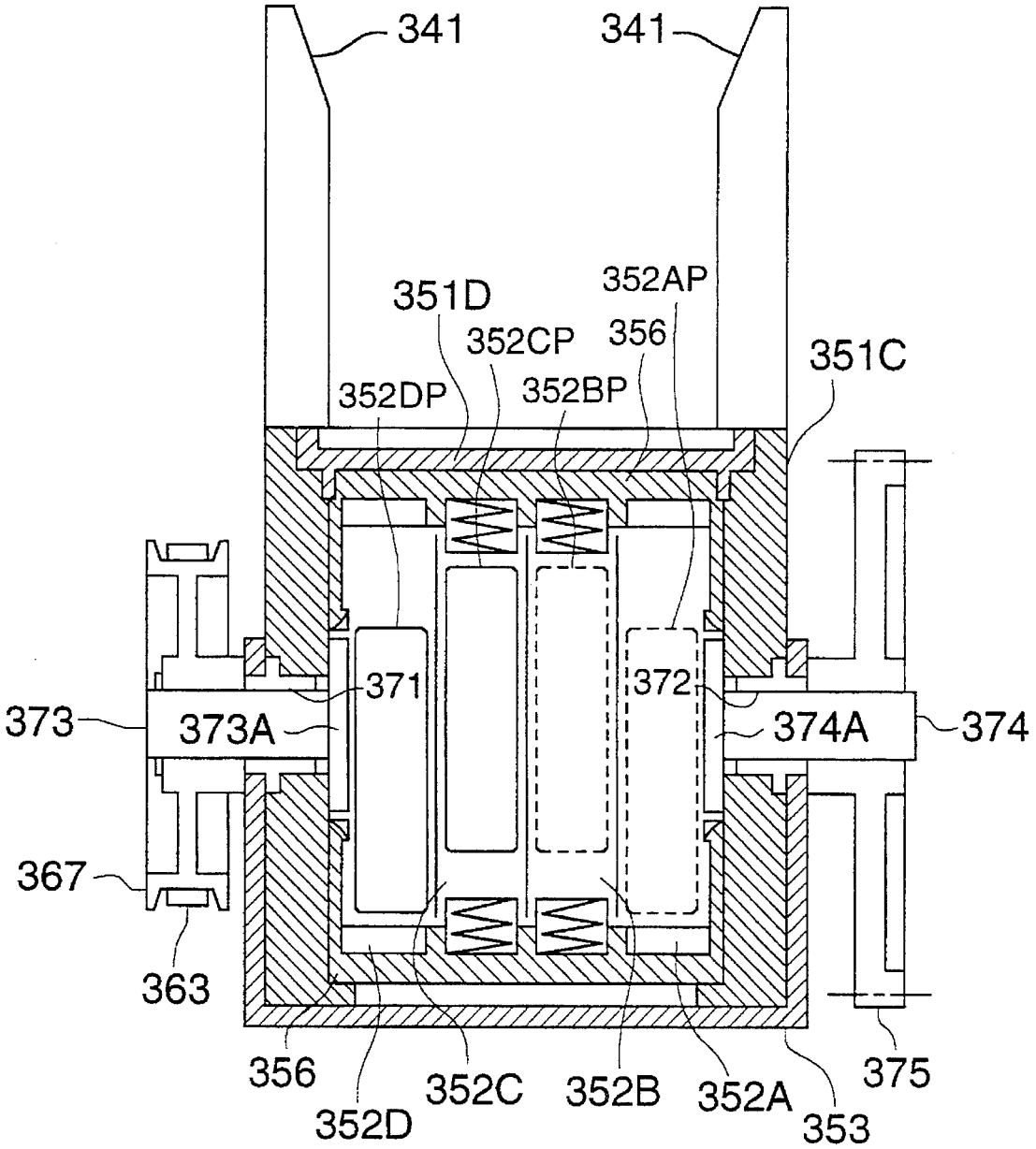
FIG. 17 is a sectional view of the solid processing agent supply means.
Figure 18:
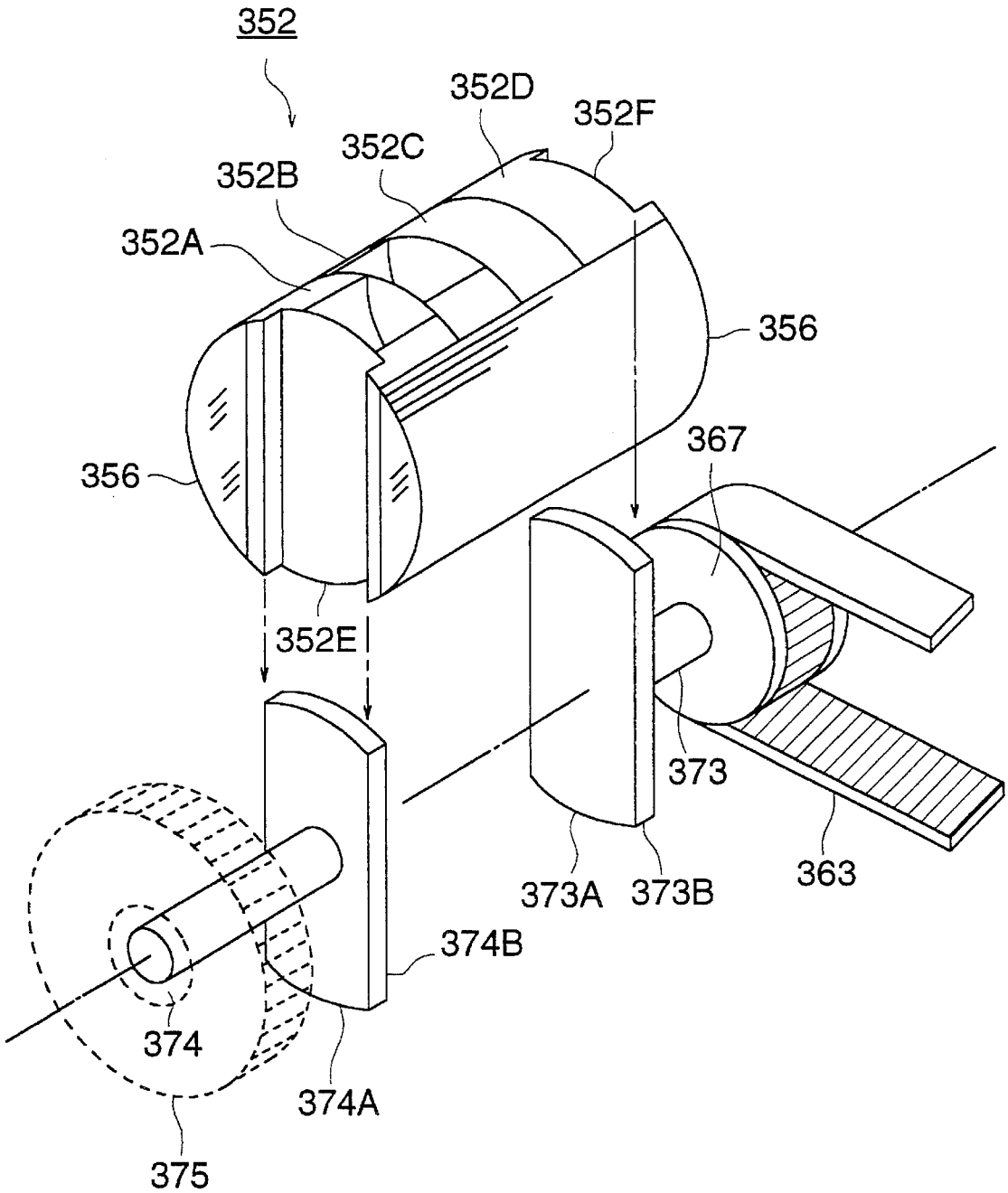
FIG. 18 is a sectional view of the solid processing agent conveyance member and the drive section.

FIG. 17 is a sectional view taken on line A—A in FIG. 7 showing the solid processing agent supply means 35. FIG. 18 is a perspective view of the solid processing agent conveyance member (rotor) 352 and the drive section.

The rotor 352 having 4 pockets (352AP, 352BP . . . ) are interposed between 2 sliding members 356, so that the rotor 352 and 2 sliding members 356 are integrated into one body. On both end surfaces of the rotor 352, parallel grooves 352E, 352F are formed. The parallel grooves 352E, 352F are respectively formed to be parallel.

Bearings 371, 372 are attached on both sides of the fixed frame body 351C of the housing member 351, and mounted on the same shaft. The bearing 371 is engaged with a rotational shaft 373 of a pulley 367 around which a timing belt 363 is wound so that the pulley 367 can be idly driven. A flat surface plate 373A having parallel sides 373B is provided at one end of the rotational shaft 373. A flat surface plate 374A having parallel sides 374B is also provided at one end of the rotational shaft 374 engaging with another bearing 372. At another end of the rotational shaft 374, a gear for rotating the shutter member 353 is fixed, so that a drive force is transmitted from the surface plate 373A to the surface plate 374A through the rotor 352.

One surface plate 373A is engaged with the parallel groove 352F of the rotor 352. The other surface plate 374A is engaged with the parallel groove 352E of the rotor 352. In this connection, the configurations land dimensions of the parallel grooves 352E, 352F may be different from those of parallel sides 374B, 373B of the surface plate. Due to the foregoing, it is possible to prevent the rotor from being reversely inserted. When the rotor 352 is disconnected, the rotor 352, housing member 351 and others are cleaned and inspected.

When the rotor 352 is attached to the drive shaft of the supply means 35, operation is conducted as follows. After the cover member 351D has been opened, as illustrated in FIG. 18, the parallel side surfaces 373B, 374B of each surface plate are held to be parallel. The rotor 352 is held and lowered downward as illustrated by a one-dotted chain line in the drawing. The parallel grooves 352E, 352F of the rotor 352 are respectively slid on and engaged with the parallel sides 374B, 373B of the surface plate. In this way, the rotor 352 is accommodated at a predetermined position in the fixed frame body 351C. After that, when the cover member 351D is closed, it becomes possible to start replenishing the solid processing agent.

Figure 19:
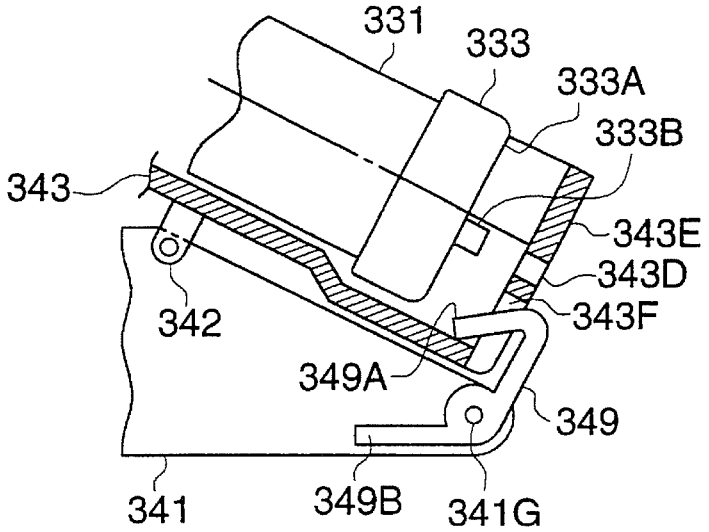
FIGS. 19(A) to 19(C) are sectional views showing the accommodating container lock mechanism of the accommodating container charging means.
Figure 19:
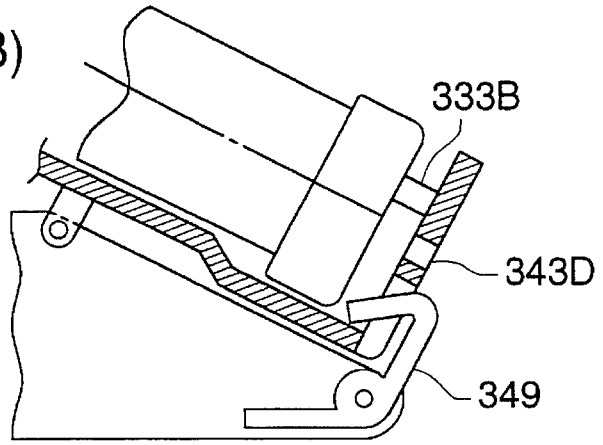
Figure 19:
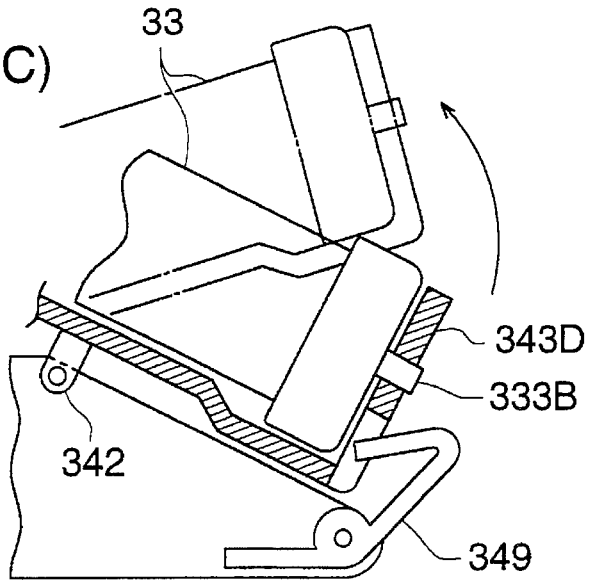

FIG. 19 is a sectional view showing the accommodating container lock mechanism of the accommodating container charging means 34.

A plurality of projections (wrong charge preventing pins) 333B are provided on the back surface 333A of the cap member 333 of the accommodating container 33. On the other hand, a plurality of wrong charge preventing holes 343D are formed on a collision surface 343E of the container holding member 343. Only when the accommodating container 33 including the appropriate solid processing agent J for the processing solution in the processing tank 1 is set to the accommodating container charging device 34, the wrong charge preventing pin 333B engages with the wrong charge preventing hole 343D, so that the accommodating container 33 can be charged. A cutout hole 343F is formed at a lower position of the collision surface 343E of the container holding member 343, so that a claw 349A at the fore end of the lock claw 349 can be inserted into the hole.

A support shaft 341G penetrates one end of the fixed frame 341, and the lock claw 349 is rotatably supported by the support shaft 341G. One end of the lock claw 349 is bent and formed into a bent claw 349A, and the other end of the lock claw 349 is formed into a balance arm 349B. Under the condition that an external force is not given to the lock claw 349, the claw 349A is raised by the weight of the balance arm 349B, so that the claw 349A enters the cutout hole 343F and protrudes from the inside surface of the container holding member 343. In the case where all the tablets of solid processing agent J in the accommodating container 33 have been used up so that the accommodating container 33 does not slide to the collision surface 343E by the weight, or in the case where the accommodating container 33 is not charged so that it does not come into contact with the collision surface 343E (shown in FIG. 19(A)), the claw 349A of the lock claw 349 is hooked at the bottom wall of the fixed frame 341 close to the cutout hole 343F. Therefore, the container holding member 343 can not be rotated around the support shaft 342. Accordingly, it is impossible to replenish the solid processing agent to the accommodating container 33.

FIG. 19(B) is a sectional view for explaining the prevention of wrong charging motion of the accommodating container 33. In the case where the accommodating container 33 is charged upside down or the accommodating container 33 including different solid processing agent J is charged to the accommodating container holding member 343, the wrong charge preventing pin 333B does not coincide with the wrong charge preventing hole 343D, so that the pin 333B collides with the collision surface 343E, and the lock claw 349 engages with the container holding member 343 and the container holding member 343 can not be rotated.

FIG. 19(C) shows a condition in which the correct accommodating container 33 is charged. Under this condition, the pin 333B engages with the wrong charge preventing hole 343D, and the back surface 333A of the accommodating container 33 comes into contact with the collision surface 343E. Therefore, the back surface 343E pushes the claw 349A of the lock claw 349 and rotates it clockwise. Due to the foregoing, engagement between the claw 349A and the bottom surface close to the cutout hole 343F is released, so that the container holding member 343 can be rotated upward around the support shaft 342.

As explained above, in the case of misoperation or inappropriate operation, the accommodating container 33 can not be set. In this way, only correct solid processing agent can be replenished to the apparatus.

As explained above, the solid processing agent replenishment device of the present invention can be installed in a small space above the automatic developing apparatus, and the solid processing agent can be dropped into a small space on the constant temperature tank. Accordingly, the automatic developing apparatus can be made compact, and the workability of accommodating container replacement can be improved. A predetermined amount of tablet type solid processing agent can be positively fed to the processing tank, and stable photographic performance can be provided.

The tablet type solid processing agent held in the accommodating container does not absorb moisture contained in processing agent vapor in the process of replenishment. Therefore, the tablet type solid processing agent can be maintained in a perfect moisture-proof condition, so that the quality can be stably maintained.

Further, according to the solid processing agent supply means of the present invention, the housing member can be divided into 2 pieces, so that the solid processing agent supply means can be easily set in an opening condition. The rotor does not include a rotational shaft, and the coupling means is provided on the drive shaft side so that the rotor 352 can be detached. Accordingly, pieces and powder of the tablet type solid processing agent J clogged in the rotor 352 and the housing member 351 can be easily inspected and cleaned.

What is claimed is:

1. An apparatus for processing a photosensitive material, comprising:

a processing tank in which a processing solution to process an exposed photosensitive material is stored; and a solid processing agent replenishing device to replenish a tablet of a solid processing agent into the processing tank, wherein a cross-section of the tablet is shaped in a circle;

the solid processing agent replenishing device including:

a container in which a plurality of the tablets are accommodated, the container having an opening through which a tablet is discharged from the container;

charging means for charging the container, and which can move the container from a first position before charging the container to a second position at which the tablet of the solid processing agent is supplied; and wherein the container is provided with a discriminating section, and wherein, when the discriminating section detects a predetermined discriminated section, the charging means is allowed to move the container from the first position to the second position.

2. The apparatus of claim 1, further comprising means for locking the container at the first position, and for releasing the container from the locking when the discriminating section detects the predetermined discriminated section.

3. An apparatus for processing a photosensitive material, comprising:

a processing tank in which a processing solution to process an exposed photosensitive material is stored; and a solid processing agent replenishing device to replenish a tablet of a solid processing agent into the processing tank, wherein a cross-section of the tablet is shaped in a circle;

the solid processing agent replenishing device including:

a container in which a plurality of the tablets are accommodated in such a manner that an outer circumference of each tablet is contacted with an outer circumference of at least another of the other tablets in the container, the container including an opening through which a tablet is discharged from the container;

a cover member to open or close the opening;

holding means for detachably holding the container; and supplying means for supplying into the processing tank a tablet of the solid processing agent which is discharged from the opening of the container; and wherein the supplying means includes a housing member having an inlet section through which tablets of the solid processing agent, which are to be discharged from the opening of the container, are introduced into the housing member and an outlet section through which the tablet of the solid processing agent is supplied to the processing tank, and a solid processing agent receiving member to move the tablet of the solid processing agent from the inlet section to the outlet section.

4. The apparatus of claim 3, wherein:

the holding means includes a charging member for urging the container to the supplying means; and the holding means has a first position at which the container is not urged to the supplying means, and a second position at which the tablet is supplied from the container and the holding means holds the container in an inclined position so that the opening of the container is positioned lower than an end of the container opposite to the opening.

5. The apparatus of claim 4, wherein the solid processing agent receiving member is arranged so as to be rotatable along an inner circumference of the housing member.

6. The apparatus of claim 4, wherein the cover member comprises a slidable lid, and wherein, by an operation to charge the container on the charging member, the slidable lid is brought in engagement with a protrusion provided in the vicinity of the inlet section of the supplying means and is moved by the protrusion so as to open the opening of the container, and by an operation to detach the container from the charging means, the slidable lid is returned so as to close the opening, and after the opening is closed, the slidable lid is released from the engagement with the protrusion and the container is detached from the charging means.

7. The apparatus of claim 4, wherein:

a packing member is provided in the vicinity of a periphery of the inlet section of the housing member; and a pressing member is provided on the charging member, and wherein, when the container is charged on the charging means, the pressing member presses the container so that the opening of the container is brought in close contact with the inlet section of the housing member and with the packing member, and the tablet of the solid processing agent accommodated in the container is isolated from the outside air.

8. The apparatus of claim 4, wherein the charging member is supported so as to be rockable on a fulcrum shaft provided on a part of the photosensitive material processing apparatus.

9. The apparatus of claim 4, wherein a protrusion member is provided in the vicinity of the opening, and the protrusion member is used as a position regulating means at a time of charging the container to the charging member.

10. The apparatus of claim 3, wherein the housing member comprises a shutter member which is slidable on the outlet section of the housing member, and wherein the shutter member is moved interlockingly with movement of the solid processing agent receiving member of the housing member and the outlet section is opened or closed by the shutter member.

11. The apparatus of claim 3, wherein:

the solid processing agent receiving member includes a solid processing agent receiving section and a moisture-proofing slide member; and isolation of the inlet section from the outside air, isolation of the outlet section from the outside air, reception of the tablet and discharge of the tablet are conducted sequentially with a rotating motion of the solid processing agent receiving member.

12. The apparatus of claim 11, wherein the moisture-proofing slide member comprises:

an elastic member to increase close contactness; and a low friction coefficient member to increase slidability of the slide member.

13. The apparatus of claim 11, wherein the solid processing agent receiving member is arranged so as to be rotatable along an inner circumference of the housing member.

14. The apparatus of claim 3, wherein the container is separated into plural chambers with a partition member, and the plurality of the tablets of the solid processing agent are accommodated in a line arrangement in each of the plural chambers.

15. The apparatus of claim 14, wherein a protrusion member is provided on an inside wall of the container in the vicinity of the opening, said protrusion being perpendicular to the partition member, and wherein powder derived from the tablets is received by the protrusion member.

16. The apparatus of claim 3, further comprising:

a cap member provided on an end of the container opposite to the opening; and a protrusion member provided on an outside of the cap member.

17. The apparatus of claim 3, further comprising:

a cap member provided on an end of the container opposite to the opening; and a cushion member provided on an inside of the cap member.

18. The apparatus of claim 3, wherein:

the supplying means further comprises a transporting member for transporting a tablet from the inlet section to the outlet section;

said transporting member is rotatably provided inside the housing member;

the housing member comprises a fixed body and a lid member which is separable from the fixed body and which is opened or closed against the fixed body; and the transporting member is exposed or detachable when the lid member is opened;

a coupling means is provided to couple a driven portion of the solid processing agent receiving member with a driving shaft and the solid processing agent receiving member is detachably connected to the driving shaft and is dismounted from the housing member by opening the lid.

19. An apparatus for processing a photosensitive material, comprising:

a processing tank in which a processing solution to process an exposed photosensitive material is stored; and a solid processing agent replenishing device to replenish a tablet of a solid processing agent into the processing tank, wherein a cross-section of the tablet is shaped in a circle;

the solid processing agent replenishing device including:

a container in which a plurality of the tablets are accommodated in such a manner that an outer circumference of each tablet is contacted with an outer circumference of at least another of the other tablets in the container, the container including an opening through which a tablet is discharged from the container;

a cover member to open or close the opening;

holding means for detachably holding the container; and wherein the container is separated into plural chambers with a partition member, and the plurality of the tablets of the solid processing agent are accommodated in a line arrangement in each of the plural chambers.

20. The apparatus of claim 19, wherein said container is elongated, and said chambers extend in a lengthwise direction of said container with adjacent chambers separated by a partition member which extends in the lengthwise direction of said container.

* * * * *